US009122183B2

(12) United States Patent
Toshine et al.

(10) Patent No.: US 9,122,183 B2
(45) Date of Patent: Sep. 1, 2015

(54) ELECTROPHOTOGRAPHIC PHOTORECEPTOR, IMAGE FORMING APPARATUS AND PROCESS CARTRIDGE

(71) Applicants: Tetsuya Toshine, Shizuoka (JP); Hiroshi Ikuno, Kanagawa (JP); Naohiro Toda, Kanagawa (JP); Takafumi Iwamoto, Shizuoka (JP); Kazuhiro Egawa, Shizuoka (JP); Toshihiro Ishida, Shizuoka (JP)

(72) Inventors: Tetsuya Toshine, Shizuoka (JP); Hiroshi Ikuno, Kanagawa (JP); Naohiro Toda, Kanagawa (JP); Takafumi Iwamoto, Shizuoka (JP); Kazuhiro Egawa, Shizuoka (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/785,242

(22) Filed: Mar. 5, 2013

(65) Prior Publication Data

US 2013/0244150 A1 Sep. 19, 2013

(30) Foreign Application Priority Data

Mar. 16, 2012 (JP) ..... 2012-060721

(51) Int. Cl.

| | |
|---|---|
| ***G03G 5/14*** | (2006.01) |
| ***G03G 5/147*** | (2006.01) |
| ***G03G 5/06*** | (2006.01) |

(52) U.S. Cl.

CPC ..... *G03G 5/14773* (2013.01); *G03G 5/0614* (2013.01); *G03G 5/1476* (2013.01); *G03G 5/14704* (2013.01); *G03G 5/14717* (2013.01); *G03G 5/14721* (2013.01); *G03G 5/14726* (2013.01); *G03G 5/14734* (2013.01); (Continued)

(58) Field of Classification Search

CPC ..... G03G 5/14773; G03G 5/14734; G03G 5/14717; G03G 5/14769; G03G 5/14756; G03G 5/14752; G03G 5/1476

USPC ..... 430/66; 399/159

See application file for complete search history.

(56) References Cited

U.S. PATENT DOCUMENTS

| | | | | |
|---|---|---|---|---|
| 2006/0051688 | A1 | 3/2006 | Toda et al. | |
| 2007/0105031 | A1 * | 5/2007 | Fukushima et al. | 430/58.65 |

(Continued)

FOREIGN PATENT DOCUMENTS

| | | |
|---|---|---|
| JP | 63-159865 | * 12/1986 |
| JP | 3-045962 | 2/1991 |

(Continued)

OTHER PUBLICATIONS

Translation of the abstract of JP 63-159865 published Dec. 1986.*

*Primary Examiner* — Peter Vajda

(74) *Attorney, Agent, or Firm* — Oblon, McClelland, Maier & Neustadt, L.L.P.

(57) ABSTRACT

An electrophotographic photoreceptor, including an electroconductive substrate; a photosensitive layer overlying the electroconductive substrate; and a surface layer overlying the photosensitive layer, wherein the surface layer includes a resin having no charge transportability; and an inorganic particulate material, wherein the inorganic particulate material is a zinc oxide doped with a boron group, and wherein the electrophotographic photoreceptor has a surface specific resistivity (R1) not less than $10^{13}$ Ω/cm$^2$ when the surface layer has an electric field intensity of $1\times10^4$ V/cm, and a ratio (R1/R15) of the surface specific resistivity (R1) to a surface specific resistivity (R15) when the surface layer has an electric field intensity of $1.5\times10^5$ V/cm of from 100 to 5,000.

13 Claims, 2 Drawing Sheets

(52) U.S. Cl.
CPC ..... *G03G5/14752* (2013.01); *G03G 5/14756* (2013.01); *G03G 5/14769* (2013.01); *G03G 5/14791* (2013.01)

(56) References Cited

U.S. PATENT DOCUMENTS

| | | | | |
|---|---|---|---|---|
| 2009/0238589 | A1* | 9/2009 | Shigezaki et al. | 399/49 |
| 2010/0330473 | A1* | 12/2010 | Haruyama et al. | 430/56 |

FOREIGN PATENT DOCUMENTS

| | | |
|---|---|---|
| JP | 4-226469 | 8/1992 |
| JP | 5-142846 | 6/1993 |
| JP | 5-181299 | 7/1993 |
| JP | 7-281463 | 10/1995 |
| JP | 9-026685 | 1/1997 |
| JP | 2000-284514 | 10/2000 |
| JP | 2001-194813 | 7/2001 |
| JP | 2002-006526 | 1/2002 |
| JP | 2002-082465 | 3/2002 |
| JP | 2002-207308 | 7/2002 |
| JP | 2002-229240 | 8/2002 |
| JP | 2002-229241 | 8/2002 |
| JP | 2002-268257 | 9/2002 |
| JP | 2005-215143 | 8/2005 |
| JP | 2006-010806 | 1/2006 |
| JP | 2006-099028 | 4/2006 |
| JP | 2008-090214 | 4/2008 |
| JP | 2009-288402 | 12/2009 |
| JP | 2010-078640 | 4/2010 |
| JP | 2010-107962 | 5/2010 |
| JP | 2010-122339 | 6/2010 |
| JP | 2010-134071 | 6/2010 |
| JP | 2010-139618 | 6/2010 |
| JP | 2010-164952 | 7/2010 |
| JP | 2010-180079 | 8/2010 |
| JP | 2011-085621 | 4/2011 |
| JP | 2011-154260 | 8/2011 |
| JP | 2011-170129 | 9/2011 |
| JP | 2012-008527 | 1/2012 |

* cited by examiner

ELECTROPHOTOGRAPHIC PHOTORECEPTOR, IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Application No. 2012-060721, filed on Mar. 16, 2012, in the Japan Patent Office, the entire disclosure of which is hereby incorporated by reference herein.

BACKGROUND OF THE INVENTION

1. Field of the Invention

The present invention relates to an electrophotographic photoreceptor, and an image forming apparatus and a process cartridge using the electrophotographic photoreceptor.

2. Description of the Related Art

Recently, in terms of saving spaces in offices and expanding business opportunities, an image forming apparatus has been required to have higher speed, smaller size, produce higher quality full-color images and easy maintenance. These relate to improvement of electrical properties and durability of an electrophotographic photoreceptor to be achieved.

In order to achieve these, trials to reduce image defects due to the electrophotographic photoreceptor when used for long periods are made, and a number of developments to make the electrophotographic photoreceptor have longer life are disclosed. In order to make the electrophotographic photoreceptor have longer life, durability thereof against various hazards it receives when producing images needs improving. The hazards are broadly classified into a mechanical hazard and a chemical hazard.

As an example of the mechanical hazard, a hazard due to a cleaner removing a toner remaining on the electrophotographic photoreceptor is known. The cleaner contacts an elastic member such as a cleaning blade to the surface of the photoreceptor to forcibly remove a toner therefrom, and has large toner removability while saving space. This is known as an effective means for downsizing an image forming apparatus, but this directly contacts an elastic member such as a cleaning blade to the surface of the photoreceptor, which is frictionized thereby. Therefore, the electrophotographic photoreceptor receives such a large mechanical stress that the surface thereof is likely to be abraded. For example, Japanese published unexamined applications Nos. JP-H05-181299-A, JP-2002-06526-A, JP-2002-82465, JP-2000-284514-A and JP-2001-194813-A disclose methods of preventing abrasion of the electrophotographic photoreceptor by forming a high-hardness protection layer thereon.

As the chemical hazards, hazards due to an oxidizing gas and an alkaline gas generated when the surface of the electrophotographic photoreceptor is charged are known. When the electrophotographic photoreceptor is exposed to oxidizing gases such as ozone and nitrogen oxides generated near a charger (KONICA Technology Report Vo. 13 (2000)), a charge transport material such as a hole transport material and an electron transport material deteriorates due to the oxidizing gases (Journal of Imaging Science 32:205-210 (1998)), resulting in deterioration of properties of the electrophotographic photoreceptor. When a short-life electrophotographic photoreceptor is used, the oxidizing gas deteriorates only the outermost surface layer in many cases to keep deteriorated components in a small amount. When a long-life electrophotographic photoreceptor is used, the oxidizing gas occasionally deteriorates even an inside of the electrophotographic photoreceptor, resulting in deterioration of image density and occurrence of background fouling, i.e., it is unable to keep producing high-quality images for long periods.

In order to solve problems of the chemical hazards, Japanese published unexamined application No. JP-2006-99028-A discloses a method of preventing deterioration of the charge transport material due to the oxidizing gas by adding an antioxidant into a charge transport layer and a surface layer. In addition, in order to prevent the oxidizing gas from penetrating the charge transport layer and the surface layer, Japanese published unexamined applications Nos. JP-H03-45962-A and JP-H07-281463-A disclose methods of reducing their permeability to gas. Further, Japanese published unexamined applications Nos. JP-H09-26685-A and JP-2002-229241-A disclose methods of preventing a discharge product (oxidizing gas) from generating in the charging process.

However, even these methods do not substantially improve the deterioration because the electrophotographic photoreceptor includes oxidized and deteriorated components in a large amount, and it is still unable to keep producing high-quality images for long periods.

As another example of the chemical hazards, an electrostatic hazard due to an electrostatic stress to the electrophotographic photoreceptor is known. The electrostatic hazard is a hazard due to an electrostatic stress to the electrophotographic photoreceptor because a charge passes each layer, e.g., a surface layer, a charge generation layer, a charge transport layer and an intermediate layer when the electrophotographic photoreceptor is irradiated to remove a charge on the surface thereof in an ordinary image forming process. At present, most of the electrophotographic photoreceptors widely used are formed of organic materials. When the electrophotographic photoreceptors formed of an organic material is repeatedly charged and discharged, the organic material gradually deteriorates, resulting in generation of charge trap in the layer and deterioration of electrical properties, i.e. chargeability and optical attenuation of the electrophotographic photoreceptor.

In order to solve problems of the chemical hazards, Japanese Patent No. JP-2795566-B1 (JP-H05-142846-A) discloses a method of dispersing an inorganic particulate material to vary film resistance by an electric field intensity. In a high electric field of $1\times10^5$ V/cm, a resistivity is maintained at not less than $10^{14}$ Ω·cm. In a high electric field of $2\times10^5$ V/cm, the surface layer has lower resistivity such that the electrophotographic photoreceptor has better charge transportability and produces clear images.

However, the resistivity not less than $10^{14}$ Ω·cm in a high electric field of $1\times10^5$ V/cm does not obtain sufficient charge transportability, resulting in higher residual potential of the electrophotographic photoreceptor. In addition, the content of the inorganic particulate material of 10 to 40% by weight disclosed in the method needs a high resistivity inorganic particulate material to have the resistivity. The inorganic particulate material is short of bulk conductivity and limited current conductivity becomes dominant, resulting in noticeable increase of residual potential of the electrophotographic photoreceptor when producing images for long periods.

Further, the electrophotographic photoreceptor is required to produce high-quality images and image quality stability for long periods is essential. In order to achieve the image quality stability, improvements of toner transferability and cleanability are required. As methods of improving image quality stability, Japanese published unexamined applications Nos. JP-2009-288402-A and JP-2008-090214-A disclose methods of including a particulate fluorine material in the surface layer of a photoreceptor. However, simply including a particulate fluorine material in the surface layer is not sufficient for image quality stability including durability of the photoreceptor when used for long periods.

As mentioned above, in order to achieve longer life of the electrophotographic photoreceptor, it needs to have durability against the mechanical and chemical hazards. The present inventors particularly pay attention to solve problems of the chemical hazard, and try to radically solve them by reducing the charge transport material included in the surface layer to reduce deteriorated charge transport material. It is difficult to maintain chargeability, charge transportability and latent image retainability required for the electrophotographic photoreceptor while reducing the charge transport material in the surface layer. The chargeability can be maintained if a charge transport material is included in a photosensitive layer formed under the surface layer. However, since the charge transportability and the latent image retainability are required in the surface layer, they cannot be maintained if the charge transport material in the surface layer is reduced. Therefore, methods of maintaining the charge transportability and the latent image retainability while reducing the charge transport material in the surface layer are urgently required.

Even when there is little electrostatic deterioration, it is essential to reduce abrasion due to the mechanical hazard loaded on the electrophotographic photoreceptor in image forming process and prevent the surface thereof from being contaminated when the electrophotographic photoreceptor is used for long periods. A paper powder and an external additive of the toner adhere to (stick in) the photoreceptor to cause the contamination. The contaminated surface is not correctly charged or irradiated, resulting in occasional production of abnormal images. A photoreceptor having low mechanical durability is abraded at its outermost surface and a new surface sequentially appears to prevent production of abnormal images, but it is difficult to have a long life.

Therefore, it is very important for an organic photoreceptor to prevent surface contamination to have a long life. The mechanical durability of the surface layer is effectively improved to reduce abrasion, which includes a risk of surface contamination.

As a method of improving the mechanical durability of the surface layer of the electrophotographic photoreceptor, Japanese published unexamined application No. JP-2002-139859-A discloses an electrophotographic photoreceptor formed of an electroconductive substrate, and a photosensitive layer and a protection layer including a filler overlying the substrate.

In addition, methods of increasing hardness of the surface layer to improve the mechanical durability thereof are disclosed in Japanese published unexamined applications Nos. JP-2001-125286-A and JP-2001-324857-A. Hardness of the protection layer of a photoreceptor is increased therein because the photoreceptor is damaged with a particulate magnetic material undesirably transferred and pressed to the photoreceptor at a transfer part and a cleaning part when a magnetic brush charger is used.

Improving the mechanical durability of the surface of the electrophotographic photoreceptor is effective for decreasing abrasion thereof, but not always effective for preventing surface contamination. Even when the mechanical durability of the electrophotographic photoreceptor is improved, an extraneous matter contaminating the photoreceptor accumulates when used for long periods.

Because of these reasons, a need exist for an electrophotographic photoreceptor having both charge transportability and latent image retainability even with a small amount of a charge transport material in the surface layer, and high durability of good electrical properties and continuously producing high-quality images even when used for long periods.

SUMMARY OF THE INVENTION

Accordingly, one object of the present invention to provide an electrophotographic photoreceptor having both charge transportability and latent image retainability even with a small amount of a charge transport material in the surface layer, and high durability of good electrical properties and continuously producing high-quality images even when used for long periods.

Another object of the present invention to provide an image forming apparatus using the electrophotographic photoreceptor.

A further object of the present invention to provide a process cartridge using the electrophotographic photoreceptor.

These objects and other objects of the present invention, either individually or collectively, have been satisfied by the discovery of an electrophotographic photoreceptor, comprising:

an electroconductive substrate;

a photosensitive layer overlying the electroconductive substrate; and a surface layer overlying the photosensitive layer, wherein the surface layer comprises:

a resin having no charge transportability; and an inorganic particulate material, wherein the inorganic particulate material is a zinc oxide doped with a boron group, and wherein the electrophotographic photoreceptor has a surface specific resistivity (R1) not less than $10^{13}$ $\Omega/cm^2$ when the surface layer has an electric field intensity of $1\times10^4$ V/cm, and a ratio (R1/R15) of the surface specific resistivity (R1) to a surface specific resistivity (R15) when the surface layer has an electric field intensity of $1.5\times10^5$ V/cm of from 100 to 5,000.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
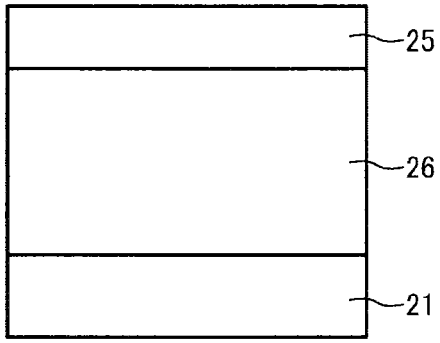
FIG. 1 is a schematic view illustrating an embodiment of the layer structure of the electrophotographic photoreceptor of the present invention.

The present invention provides an electrophotographic photoreceptor having both charge transportability and latent image retainability even with a small amount of a charge transport material in the surface layer, and high durability of good electrical properties and continuously producing high-quality images even when used for long periods.

More particularly, the present invention relates to an electrophotographic photoreceptor, comprising:

an electroconductive substrate;

a photosensitive layer overlying the electroconductive substrate; and a surface layer overlying the photosensitive layer, wherein the surface layer comprises:

a resin having no charge transportability; and an inorganic particulate material, wherein the inorganic particulate material is a zinc oxide doped with a boron group, and wherein the electrophotographic photoreceptor has a surface specific resistivity (R1) not less than $10^{13}$ Ω/cm$^2$ when the surface layer has an electric field intensity of $1\times10^4$ V/cm, and a ratio (R1/R15) of the surface specific resistivity (R1) to a surface specific resistivity (R15) when the surface layer has an electric field intensity of $1.5\times10^5$ V/cm of from 100 to 5,000.

The electrophotographic photoreceptor of the present invention includes at least a photosensitive layer and a surface layer on an electroconductive substrate in this order, and other layers when necessary.

The electrophotographic photoreceptor of the present invention has specified materials in the surface layer and a surface resistivity. Conventional electroconductive substrates, photosensitive layers and other layers can be used.

The surface layer includes at least a resin having no charge transportability and an inorganic particulate material, and other additives when necessary. Further, the surface layer has the surface specific resistivity specified in the present invention and preferably has a hardness and an elastic power specified in the present invention.

Even when a charge transport material is reduced the surface layer, the electrophotographic photoreceptor needs to maintain chargeability, charge transportability and latent image retainability. The photosensitive layer can have chargeability, and it is thought that the surface layer needs to have charge transportability and latent image retainability. The present inventors found that the surface layer needs to have a high resistivity when having an electric field intensity of from $1\times10^4$ to $3\times10^4$ V/cm lower than when the electrophotographic photoreceptor is driven and a low resistivity when having an electric field intensity of $1.5\times10^5$ V/cm equal to when the electrophotographic photoreceptor is driven.

The surface specific resistivity R1 is a surface specific resistivity when the surface layer has an electric field intensity of $1\times10^4$ V/cm.

The surface specific resistivity R1 is not particularly limited, if it is less than $10^{13}$ Ω/cm$^2$, and preferably $10^{14}$ Ω/cm$^2$ in terms of good latent image retainability. When less than $10^{13}$ Ω/cm$^2$, latent image retainability is not sufficient, resulting in occasional thin dot images and blurred images. When the surface layer has a high resistivity when having an electric field intensity of $1\times10^4$ V/cm, charge transport is prevented to increase latent image retainability.

The surface specific resistivity R3 is a surface specific resistivity when the surface layer has an electric field intensity of $3\times10^4$ V/cm.

A surface specific resistivity R3 is not particularly limited, and preferably $10^{14}$ Ω/cm$^2$ in terms of good latent image retainability. When the surface layer has a high resistivity when having an electric field intensity of $3\times10^4$ V/cm, charge transport is prevented to increase latent image retainability.

The surface specific resistivity R15 is a surface specific resistivity when the surface layer has an electric field intensity of $1.5\times10^5$ V/cm.

A surface specific resistivity R15 is not particularly limited, and preferably from $1\times10^9$ to $1\times10^{11}$ Ω/cm$^2$ in terms of reduction of irradiated part potential.

A ratio (R1/R3) of R1 to R3 is not particularly limited, and preferably from 0.1 to 10, and more preferably from 0.1 to 2 in terms of decreasing resistivity variation. When less than 0.1, charge transportability deteriorates and residual potential occasionally increases. When greater than 10, latent image retainability is not sufficient, resulting in occasional thin dot images.

A ratio (R1/R15) of R1 to R15 is not particularly limited, if it is from 100 to 5,000, and preferably from 100 to 1,000. When less than 100, the surface layer does not have sufficient charge transportability, resulting in occasional production of defective images due to increase of residual potential. When greater than 5,000, the electrophotographic photoreceptor does not have sufficient chargeability, resulting in possible production of images having background fouling and lower gradation. When R15 is smaller than R1, charge transportability improves. When the surface layer has high resistivity when having an electric field intensity of $1.5\times10^5$ V/cm, charge transportability improves more.

Methods of measuring the surface specific resistivity are not particularly limited, e.g., JIS-C2139:2008 (solid electric insulative material-volume resistivity and surface resistivity measurement method) can be used. The electrophotographic photoreceptor typically has the shape of a cylinder, and when it is difficult to measure by JIS-C2139:2008, the following method may be used.

Current-voltage meters used for measuring sample passing current when a voltage is applied are not particularly limited, if the electric field intensity ($1\times10^4$ V/cm) in the present invention can be measured, e.g., a high-sensitive ammeter Source Measure Unit Type 2410 from Keithley Instruments, Inc. can be used.

Methods of preparing an electrode used for measuring the surface specific resistivity are not particularly limited, and a vacuum deposition method is preferably used in terms of avoiding deterioration of compositions of the electrophotographic photoreceptor.

Metals forming the electrode are not particularly limited, if it can form an electrode on the surface of the electrophotographic photoreceptor. Specific examples thereof include gold, silver, copper, aluminum, nickel, platinum, chrome, zinc, carbon, etc. An opposite electrode is preferably formed of the same metal as that of the electrode.

Forms of the electrode are not particularly limited, and can be determined, based on a capacity of a DC voltage source and preciseness of an ammeter used for the measurement. Specific examples thereof include electrodes having a known length of from 10 to 30 mm and a known gap of from 25 to 100 μm therebetween.

Electric field applicators are not particularly limited, if it is a stable DC voltage source, and can be selected according to purposes.

Voltage application polarities are not particularly limited, and can be selected according to purposes. A negative voltage and a positive voltage are preferably applied to a negatively-charged photoreceptor and a positively-charged photoreceptor, respectively.

Methods of measuring sample passing current when a voltage is applied are not particularly limited, and can be selected according to purposes. It is preferable that the measurement is performed for not less than 60 sec, and then the surface resistivity is calculated.

Methods of setting the electric field intensity at $1\times10^4$ V/cm when measuring R1 are not particularly limited, and can be selected according to purposes. For example, a bias applied to a gap between the electrodes formed on a sample is set to set the electric field intensity at $1\times10^4$ V/cm.

Positions of the surface layer of the electrophotographic photoreceptor when measuring R1 are not particularly limited, and can be selected according to purposes.

R1 has equivalent values at any positions of the surface layer, and an average of values measured at three positions 70, 170 and 270 mm from an upper end of the surface layer of the electrophotographic photoreceptor may be used.

Methods of setting the electric field intensity at $3\times10^4$ V/cm when measuring R3 are not particularly limited, and can be selected according to purposes. For example, a bias applied to a gap between the electrodes formed on a sample is set to set the electric field intensity at $3\times10^4$ V/cm.

Positions of the surface layer of the electrophotographic photoreceptor when measuring R3 are not particularly limited, and can be selected according to purposes.

R3 has equivalent values at any positions of the surface layer, and an average of values measured at three positions 70, 170 and 270 mm from an upper end of the surface layer of the electrophotographic photoreceptor may be used.

Methods of setting the electric field intensity at $3\times10^4$ V/cm when measuring R15 are not particularly limited, and can be selected according to purposes. For example, a bias applied to a gap between the electrodes formed on a sample is set to set the electric field intensity at $3\times10^4$ V/cm.

Positions of the surface layer of the electrophotographic photoreceptor when measuring R15 are not particularly limited, and can be selected according to purposes.

R15 has equivalent values at any positions of the surface layer, and an average of values measured at three positions 70, 170 and 270 mm from an upper end of the surface layer of the electrophotographic photoreceptor may be used.

The mechanical durability and anti-contamination of the electrophotographic photoreceptor depends on a narrow area of the surface. Therefore, a universal hardness is preferably used as an index of the mechanical durability and anti-contamination of the surface layer of the electrophotographic photoreceptor.

The universal hardness of the surface layer of the electrophotographic photoreceptor is not particularly limited, and can be selected according to purposes. It is preferably not less than 200 N/mm$^2$, and more preferably not less than 250 N/mm$^2$. When not less than 200 N/mm$^2$, particulate silica included in a toner is difficult to stick in the surface layer, and the mechanical durability and anti-contamination noticeably improve. The maximum value of the universal hardness is not particularly specified, but preferably not greater than 500 N/mm$^2$ in consideration of adhesiveness between the surface layer and its underlayer.

The universal hardness is defined as F/A when an indenter is contacted to a sample at a maximum test load F to form a contact area A therebetween, and can be measured by an ultramicroscopic hardness meter. The contact area A is calculated, based on a press depth. Specific examples of the indenter include, but are not limited to, a square pyramid Vickers indenter, and a trigonal pyramid Berkovich indenter. Specific examples of the measurer include, but are not limited to, Fischer Scope H-100 from Fischer Instruments K.K.

An average of five-time measurements under the following conditions is the universal hardness of an electrophotographic photoreceptor.

Apparatus: Fischer Scope H-100 from Fischer Instruments K.K.

Software: WIN-HCU from Fischer Instruments K.K.

Max. test load: 1 mN

Load application time: 30 sec

Load increase: 1 mN/30 sec

Creep at the max. test load: 5 sec

Load reduction: 1 mN/30 sec

Creep after unloaded: 5 sec

Indenter: SMC117

The elastic power is not particularly limited, and can be selected according to purposes. It is preferably not less than 50%, and more preferably not less than 55%. The elastic power can be measured by the same method of measuring the universal hardness. The elastic power can be determined by the following formula.

$$\text{Elastic power (\%)}=100\times(\text{maximum power}-\text{plastic power})/\text{maximum power}$$

When the elastic power is not less than 50%, and preferably not less than 55%, the electrophotographic photoreceptor improves in both mechanical durability and anti-contamination.

Specific examples of the resin having no charge transportability include, but are not limited to, resins having no charge transportable structure.

Specific examples of the resins having no charge transportable structure include, but are not limited to, resins having a positive hole transport structure such as triarylamine, hydrazone, pyrazoline and carbazole; and resins having no electron transportable structure such as such as condensed polycyclic quinone, diphenoquinone, a cyano group and an electron attractive aromatic ring having a nitro group.

Besides, thermoplastic resins, thermosetting resins and photo-crosslinking resins can also be used. Specific examples thereof include acrylic resins, phenolic resins, urethane resins, silicone resins, epoxy resins, polycarbonate resins, polyarylate resins, polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, phenoxy resins, cellulose acetate resins, ethyl cellulose resins, polyvinyl butyral resins, polyvinyl formal resins, polyvinyl toluene resins, poly-N-vinyl carbazole resins, etc. These can be used alone or in combination.

Among these, polycarbonate resins and polyarylate resins are preferably used in terms of charge transportability and latent image retainability. Phenolic resins, urethane resins, silicone resins and epoxy resins having a crosslinked structure obtained by irradiating a compound having a radical polymerizable functional group to be crosslinked are more preferably used. Acrylic resins having the crosslinked structure are most preferably used.

Specific examples of the acrylic resins include, but are not limited to, methylacrylate, ethylacrylate, n-propylacrylate, isopropylacrylate, n-butylacrylate, isobutylacrylate, sec-butylacrylate, t-butylacrylate, n-hexylacrylate, cyclohexylacrylate, 2-ethylhexylacrylate, n-octylacrylate, methylmethacrylate, ethylmethacrylate, n-propylmethacrylate, isopropylmethacrylate, n-butylmethacrylate, isobutylmethacrylate, sec-butylmethacrylate, t-butylmethacrylate, n-hexylmethacrylate, cyclohexylmethacrylate, 2-ethylhexylmethacrylate, and n-octylmethacrylate.

Marketed or synthesized acrylic resins may be used. A known acrylic polymerizable compound and a known radical polymerization initiator are preferably mixed, heated or irradiated to be crosslinked for synthesizing an acrylic resin.

An acryloyloxy group and a methacryloyloxy group are preferably used as a polymerizable functional group of the acrylic polymerizable compound in terms of crosslinking reactability.

The number of the polymerizable functional group of the acrylic polymerizable compound is preferably two or more in terms of surface layer strength and layer formability. Specific examples of the acrylic polymerizable compound having two or more polymerizable functional groups include, but are not limited to, 1,3-butanedioldiacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, and EO-modified bisphenol F diacrylate.

Specific examples of the acrylic polymerizable compound having three or more polymerizable functional groups include, but are not limited to, trimethylolpropane triacrylate (TMPTA), trimethylolpropane trimethacrylate, trimethylolpropanealkylene-modified triacrylate, trimethylolpropane-ethyleneoxy-modified (hereafter EO-modified) triacrylate, trimethylolpropanepropyleneoxy-modified (hereafter PO-modified) triacrylate, trimethylolpropanecaprolactone-modified triacrylate, trimethylolpropanealkylene-modified trimethacrylate, pentaerythritol triacrylate, pentaerythritol tetracrylate (PETTA), glycerol triacrylate, glycerol epichlorohydrin-modified (hereafter ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritolcaprolactone-modified hexaacrylate, dipentaerythritolhydroxy pentaacrylate, alkylated dipentaerythritol pentacrylate, alkylated dipentaerythritol tetraacrylate, alkylated dipentaerythritol triacrylate, dimethylolpropane tetraacrylate (DTMPTA), pentaerythritolethoxy tetraacrylate, phosphoric acid EO-modified triacrylate, and 2,2,5,5-tetrahydroxymethylcyclopentanone tetracrylate. These can be used alone or in combination.

Specific examples of the radical polymerization initiator include, but are not limited to, heat polymerization initiators such as peroxide initiators and azo initiators; and photopolymerization initiators such as acetophenone photopolymerization initiators, ketal photopolymerization initiators, benzoinether photopolymerization initiators, benzophenone photopolymerization initiators, thioxanthone photopolymerization initiators, titanocene photopolymerization initiators, acridine compounds, triazine compounds and imidazole compounds. These can be used alone or in combination, and the photopolymerization initiators are preferably used.

The radical polymerization initiator can be used alone or in combination with a photopolymerization accelerator. Specific examples of the photopolymerization accelerator include, but are not limited to, triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

The surface layer of the present invention preferably includes the radical polymerization initiator in an amount of 0.5 to 40 parts by weight, and more preferably from 1 to 20 parts by weight per 100 parts by weight of the acrylic polymerizable compound.

Specific examples of the phenolic resins include, but are not limited to, novolak reins, and resol resins. The resol resin is preferably used because of having good latent image maintainability and being crosslinkable without an initiator while novolak resin needs an initiator such as an acidic catalyst.

Marketed or synthesized phenol resins may be used. A phenolic derivative having one or more methylol group in a unit structure is preferably heated and crosslinked to synthesize a phenol resin.

The phenolic derivative having one or more methylol group in a unit structure is not particularly limited, and can be selected according to purposes. However, phenolic derivatives having two or more methylol group in a unit structure are preferably used in terms of surface layer strength and layer formability.

Specific examples of the phenolic derivatives having two or more methylol group in a unit structure include, but are not limited to, dimethylol compounds of phenolic monomers, trimethylol compounds phenolic monomers, polymers such as phenolic dimers. These can be used alone or in combination.

Specific examples of the dimethylol compounds of phenolic monomers include, but are not limited to, 2,6-dihydroxymethyl-4-methylphenol, 2,4-dihydroxymethyl-4-methylphenol, 2,6-dihydroxymethyl-3,4-dimethylphenol, 4,6-dihydroxymethyl-2,3-dimethylphenol, 4-t-butyl-2,6-dihydroxymethylphenol, 4-cyclohexyl-2,6-dihydroxymethylphenol, 2-cyclohexyl-4,6-dihydroxymethylphenol, 2,6-dihydroxymethyl-4-ethylphenol, 4,6-dihydroxymethyl-2-ethylphenol, 4,6-dihydroxymethyl-2-isopropylphenol, and 6-cyclohexyl-2,4-dihydroxymethyl-3-methylphenol.

Specific examples of the trimethylol compounds phenolic monomers include, but are not limited to, 2,4,6-trihydroxymethylphenol.

Specific examples of the urethane resins include, but are not limited to, ester urethane resins, and ether urethane resins. These can be used alone or in combination.

Marketed or synthesized urethane resins may be used. A known polyol compound and a known isocyanate compound are preferably mixed, heated or irradiated to be crosslinked for synthesizing a urethane resin.

The polyol compound is not particularly limited, and can be selected according to purposes. Bi- or more functional polyol compounds are preferably used ion terms of surface layer strength and layer formability.

Specific examples of the bi- or more functional polyol compounds include, but are not limited to, diol compounds such as alkylene glycol, alkylene ether glycol, alicyclic diols, adducts of alicyclic diols with alkyleneoxide and adducts of bisphenols with alkylene oxide; polyaliphatic alcohols such as glycerin, trimethylolethane, trimethylolpropane, pentaerythritol and sorbitol; tri- or more functional phenols such as phenol novolak and cresol novolak; and tri- or more polyol compounds such as adducts of tri- or more functional phenols with alkylene oxide. These can be used alone or in combination.

The isocyanate compound is not particularly limited, and can be selected according to purposes. Bi- or more functional isocyanate compounds are preferably used ion terms of surface layer strength and layer formability.

Specific examples of the bi- or more functional isocyanate compounds include, but are not limited to, tolylenediisocyanate (TDI), diphenylmethanediisocyanate, xylenediisocyanate, hexamethylenediisocyanate, isophoronediisocyanate, bis(isocyanatemethyl)cyclohexane, trimethylhexamethylenediisocyanate, HDI isocyanate bodies, HDI biuret bodies, XDI trimethylolpropane adduct bodies, and IPDI isocyanurate bodies. These can be used alone or in combination.

The content of the isocyanate compound is preferably from 0.5 to 40 parts by weight, and more preferably from 1 to 20 parts by weight per 100 parts by weight of the polyol compound, based on an OH value and an NCO value.

Specific examples of the epoxy resins include, but are not limited to, bisphenol A epoxy resins, bisphenol F epoxy resins, cresol novolak epoxy resins, and phenol novolak epoxy resins. These can be used alone or in combination.

Marketed or synthesized epoxy resins may be used. A compound including two or more epoxy rings in a molecule and a hardener are preferably mixed, heated or irradiated to be crosslinked for synthesizing an epoxy resin.

Specific examples of the compound including two or more epoxy rings in a molecule include, but are not limited to, polyalkyleneglycoldiglycidylether, bisphenol A diglycidylether, glycerintridiglycidylether, diglyceroltridiglycidylether, diglycidylhexahydrophthalate, trimethylolpropanediglycidylether, allylglycidylether, and phenylglycidylether. These can be used alone or in combination.

Specific examples of the hardener include, but are not limited to, heat acid generators and photoacid generators such as aliphatic amine compounds, alicyclic amine compounds, aromatic amine compounds, modified amine compounds, polyamide amine, imidazole, polymercaptan, and acid anhydrides.

The content of the hardener is preferably from 0.5 to 20 parts by weight, and more preferably from 1 to 10 parts by weight per 100 parts by weight of the compound including two or more epoxy rings in a molecule.

Specific examples of the silicone resins include, but are not limited to, dimethylpolysiloxane, methylphenylpolysiloxane, octamethylcyclotetrasiloxane, decamethylcyclopentanesiloxane, vinyl silicone, polyether-modified silicone, polyglycerin-modified silicone, amino-modified silicone, epoxy-modified silicone, mercapto-modified silicone, methacryl-modified silicone, carboxylic acid-modified silicone, fatty acid ester-modified silicone, alcohol-modified silicone, alkyl-modified silicone, and fluoroalkyl-modified silicone. These can be used alone or in combination.

Marketed or synthesized silicone resins may be used. A reactive silicone compound including one or more hydrolyzable group in a silicon atom alone (or mixed with a condensation catalyst) is preferably heated to be crosslinked for synthesizing a silicone resin.

The reactive silicone compound is not particularly limited to, and can be selected according to purposes. Reactive silicone compounds including two or more hydrolyzable group in a silicon atom are preferably used. Specific examples of the hydrolyzable group include, but are not limited to, a methoxy group, an ethoxy group, a methyl ethyl ketoxime group, a diethylamino group, an acetoxy group, a propenoxy group, a propoxy group, a butoxy group, and a methoxyethoxy group.

Specific examples of the condensation catalyst include, but are not limited to, catalysts working on condensation reaction per contiguum and catalysts transferring reaction average to productive system. Specific examples thereof include alkali metal salts such as organic carboxylic acids, nitrous acids, sulfurous acids, aluminates, carbonates and thiocyanates; organic amine salts such as tetramethylammonium hydroxides and tetramethylammoniumacetate; and tin organic acid salts such as stannous octoate, dibutyltin diacetate, dibutyltin dilaurate, dibutyltin mercaptide, dibutyltin thiocarboxylate and dibutyltin maleate.

The content of the condensation catalyst is preferably from 0.5 to 20 parts by weight, and more preferably from 1 to 10 parts by weight per 100 parts by weight of the reactive silicone compound.

In the present invention, even when the content of a charge transport material in the surface layer is reduced, an inorganic particulate material dispersed therein enables the electrophotographic photoreceptor to have desired surface resistivity, charge transportability and latent image retainability. Further, zinc oxide doped with a boron group can form a surface layer having controllable surface resistivity, high electroconductivity, and stable electrical properties for long periods in the atmosphere.

The inorganic particulate material is not particularly limited, if it is zinc oxide doped with a boron group and can be selected according to purposes. Specific examples thereof include zinc oxide doped with a gallium atom, zinc oxide doped with a boron atom, zinc oxide doped with a boron atom, zinc oxide doped with an aluminum atom, zinc oxide doped with an indium atom, etc. These can be used alone or in combination. Among these, zinc oxide doped with a gallium atom is preferably used in terms of charge transportability, latent image retainability and maintaining surface layer electrical properties.

Methods of doping zinc oxide a boron group are not particularly limited to, and can be selected according to purposes. Specific examples thereof include a burning method of mixing zinc oxide which is a bulk mother body or a precursor which becomes zinc oxide when burned and a dope metal in solid forms to prepare a mixture, and burning the mixture in an atmosphere of high temperature. Doping means adding the boron group to the zinc oxide at a specified concentration.

Methods of seeing if the zinc oxide is doped with the boron group are not particularly limited to, and can be selected according to purposes. Specific examples thereof include known element analysis methods such as a X-ray photoelectron spectroscopy (XPS) method, an Auger electron spectroscopy (AES) method and an energy disperse X-ray spectroscopy (EDX) method.

The content of the boron group in zinc oxide is doped with the boron group is preferably from 0.001 to 0.2 mol, more preferably from 0.01 to 0.1 mol, and most preferably from 0.002 to 0.1 mol per 1 mol of the zinc oxide. When less than 0.001 mol, the zinc oxide occasionally deteriorates in stability of electrical properties. When greater than 0.2 mol, the stability of electrical properties and electroconductivity improving effect are saturated, and excessive elements accumulate, resulting in occasional deterioration of properties of the electrophotographic photoreceptor.

Methods of measuring the content of the boron group in the zinc oxide doped therewith are not particularly limited to, and can be selected according to purposes. Specific examples thereof include known element analysis methods such as an X-ray photoelectron spectroscopy (XPS) method, an Auger electron spectroscopy (AES) method and an energy disperse X-ray spectroscopy (EDS) method.

The zinc oxide is doped with the boron group preferably has an average primary particle diameter of from 10 to 50 nm in terms of light transmission and abrasion resistance of the surface layer. When less than 10 nm, the zinc oxide is doped with the boron group is likely to agglutinate, resulting in inability to control the surface resistivity. When greater than 50 nm, the surface layer is likely to have uneven charge transportability, resulting in occasional difficulty in forming desired latent images. In addition, the surface layer has large surface roughness and a blade cleaner mentioned later is quickly abraded, resulting in occasional occurrence of poor cleaning of toner. Further, although depending on a specific gravity of the inorganic particulate material, a life problem of a coating liquid occasionally occurs, i.e., the zinc oxide is doped with the boron group settles out in a dispersion.

The average primary particle diameter of the zinc oxide is doped with the boron group is measured by obtaining 3,000 to 10,000 times observed images with a scanning electron microscope (SEM) and analyzing randomly selected 200 particles with an image analysis software.

The content of the zinc oxide is doped with the boron group in the surface layer is preferably 7 to 40% by volume in terms of controllability of the surface resistivity, surface layer formability and abrasion resistance thereof. When less than 7% by volume, the surface resistivity of the present invention is occasionally difficult to obtain. When greater than 40% by volume, the surface layer occasionally deteriorates in layer formability or abrasion resistance.

Methods of measuring the content of the zinc oxide doped with a boron group in the surface layer are not particularly limited to, and can be selected according to purposes. Specific examples thereof include a method of using element analysis and its mapping, etc.

The method of using element analysis and its mapping is not particularly limited to, and can be selected according to purposes. Specific examples thereof include a method of using EDS-SEM, etc. The EDS-SEM is an apparatus scanning an object with a thin electron beam and detecting a second electron quantity to observe the surface of the object in detail (50 to 300,000 times), and at the same time, detecting a specific X-ray to analyze an elemental ratio in a microscopic area and perform mapping of a specific element.

The method of measuring the content of the zinc oxide doped with a boron group in the surface layer is specifically explained.

First, after the cross-sectional structure of the electrophotographic photoreceptor is exposed by conventional methods such as microtome and FIB, mapping of constituent elements of the zinc oxide doped with a boron group in the cross-section of the electrophotographic photoreceptor is performed by the above method, and dividing a detection area of the constituent elements of the zinc oxide doped with a boron group with an observed area to obtain an areal ratio of organic an inorganic complex particles in the observed cross-section. Next, the areal ratio is converted into a volume ratio (3/2 power of the areal ratio) to obtain an occupational ratio of the organic an inorganic complex particles.

Specific examples of methods of dispersing the zinc oxide doped with a boron group in the surface layer include, but are not limited to, a dispersion method typically used in the surface layer coating liquid. Specific examples of the dispersion method include, but are not limited to, methods of using a ball mill, a sand mill, a KD mill, a three-roll mill, a pressure type homogenizer, and an ultrasonic disperser.

In the present invention, a particulate fluorine-containing resin is included in the surface layer of the electrophotographic photoreceptor to improve transferability and cleanability of a toner. Specific examples of the particulate fluorine-containing resin include polytetrafluoroethylene (PTFE), copolymers of tetrafluoroethylene and perfluoroalkylvinyl ether (PFA), copolymers of tetrafluoroethylene and oxafluoropropylene (FEP), copolymers of tetrafluoroethylene, hexafluoropropylene and perfluoroalkylvinyl ether (EPE), copolymers of tetrafluoroethylene and ethylene (ETFE), polychlorotrifluoroethylene (PCTFE), copolymers of chlorotrifluoroethylene and ethylene (ECTFE), polyvinylidenefluoride (PVDF), polyvinylfluoride (PVF), etc. Among these, polytetrafluoroethylene (PTFE), copolymers of tetrafluoroethylene and perfluoroalkylvinyl ether (PFA) and copolymers of tetrafluoroethylene and oxafluoropropylene (FEP) are preferably used in the present invention because the resultant photoreceptor has lower friction coefficient and they have higher ductility.

The content of the particulate fluorine-containing resin is preferably from 10 to 70% by weight per 100% by weight of the solid content of a coating liquid. When too low, friction with the cleaning blade is not effectively reduced. When too much, resin crosslink density decreases, resulting in low mechanical durability.

Combinations of the resin having no charge transportability and the zinc oxide doped with a boron group are not particularly limited to, and can be selected according to purposes. Combinations of the zinc oxide doped with gallium and an acrylic resin, a polycarbonate resin, a polyarylate resin, a styrene resin, a phenol resin, a urethane resin and a silicone resin are preferably used in terms of good electrical properties and continued production of high-quality images.

Specific examples of the additives include, but are not limited to, a particulate metal, a compound having a reactive organic group, a dispersant, a surfactant, a charge transportable compound, a plasticizer, and a leveling agent.

Specific examples of the particulate metal include, but are not limited to, gold, silver, copper, aluminum, titanium oxide, tin oxide, zirconium oxide, indium oxide, antimony oxide, calcium oxide, ITO, silicon oxide, colloidal silica, aluminum oxide, yttrium oxide, cobalt oxide, copper oxide, iron oxide, manganese oxide, niobium oxide, vanadium oxide, selenium oxide, boron nitride, and silicon nitride.

The compound having a reactive organic group is added to form the surface layer having the specified surface resistivity in the present invention, and to decorate the surface of the zinc oxide doped with a boron group for the purpose of strengthening capabilities of the electrophotographic photoreceptor and improving dispersibility.

The compounds having a reactive organic group are not particularly limited, if it is a compound reactive with a hydroxyl group on the surface of the zinc oxide doped with a boron group, and can be selected according to purposes. Specific examples thereof include, but are not limited to, organic metal coupling agents, e.g., silane coupling agents such as hexyltrimethoxysilane, octyltrimethoxysilane and methacryloxypropylmethoxysilane; titanate coupling agents such as isopropyltris(dioctylpyrophosphate)titanate, tetra(2,2-diallyloxymethyl-1-butyl-)bis(ditridecyl)phophitetitanate, and isopropyltriisostearoyltitanate; and aluminum coupling agents such as acetoalkoxyaluminumdiisopropylate. These can be used alone or in combination.

Specific examples of methods of decorating the surface of the zinc oxide doped with a boron group include, but are not limited to, a dry method adding an aqueous or an alcohol solution including the organic metal coupling agent to the zinc oxide doped with a boron group in a high-speed stirrer such as Henschel mixer while stirring the mixture to be uniformly mixed and drying the mixture; and a wet method preparing a slurry in which the zinc oxide doped with a boron group is dispersed in an aqueous or an alcohol solution, adding the slurry to the organic metal coupling agent or an aqueous or an alcohol solution including the organic metal coupling agent while fully stirring the mixture, and then filtering, washing and drying.

Although depending on the above capabilities and the dispersibility, the coated amount of the organic metal coupling agent is preferably from 0.01 to 30% by weight, and more preferably from 0.05 to 15% by weight. When less than 0.01% by weight, the capabilities and the dispersibility are not effectively improved. When greater than 30% by weight, the organic metal coupling agent excessively adheres to the zinc oxide doped with a boron group, resulting in occasional deterioration of electrical properties of the electrophotographic photoreceptor.

A dispersant may be used to well disperse the zinc oxide doped with a boron group in the surface layer. The dispersant is not particularly limited to, and can be selected according to purposes.

The content of the dispersant is preferably from 0.5 to 30% by weight, and more preferably from 1 to 15% by weight per 100% by weight of the zinc oxide doped with a boron group. When less than 0.5% by weight, the zinc oxide doped with a boron group is not effectively dispersed. When greater than 30% by weight, a residual potential noticeably increases.

A surfactant may be used to well disperse the zinc oxide doped with a boron group in the surface layer. The surfactant is not particularly limited to, and can be selected according to purposes.

The content of the surfactant is preferably from 0.5 to 30% by weight, and more preferably from 1 to 15% by weight per 100% by weight of the zinc oxide doped with a boron group. When less than 0.5% by weight, the zinc oxide doped with a boron group is not effectively dispersed. When greater than 30% by weight, a residual potential noticeably increases.

Specific examples of the charge transport material include, but are not limited to, known hole transport materials having a hole transportable structure such as triarylamine, hydrazone, pyrazoline, and carbazole; and known electron transport materials having an electron transportable structure, e.g., electron attractive aromatic rings such as condensed polycyclic quinone, diphenoquinone, a cyano group or a nitro group. These can be used alone or in combination.

When the crosslinked polymer is used as the resin having no charge transportability, charge transport materials having a functional group such as a hydroxyl group, acryloyloxy group or a methacryloyloxy group reactable with the crosslinked polymer may be used.

The content of the charge transportable compound is preferably not greater than 20 parts by weight per 100 parts by weight of the resin having no charge transportability in terms of reducing influence of deterioration of the charge transportable compound to the properties of the electrophotographic photoreceptor.

Specific examples of methods of measuring the content of the charge transportable compound in the surface layer include, but are not limited to, an X-ray photoelectron spectroscopy (XPS) method, an energy disperse X-ray spectroscopy (EDX) method, a wavelength dispersion X-ray analysis method, a method of measuring a dyed amount with a reagent, and a Fourier transform infrared spectroscopic (FT-IR) method. Particularly, it is preferable to measure, based on a calibration curve from ratios of each peak intensity measured by the Fourier transform infrared spectroscopic (FT-IR) in terms of simplicity and high versality.

The surface layer is formed including a specific amount of the charge transportable compound and characteristic oscillation peak intensity (peak height or peak area) thereof is measured by the FT-IR method to make the calibration curve based on ratios of each oscillation peak intensity. In order to increase preciseness of the calibration curve, the surface layer may be formed including levels 2 to 5 amount of the charge transportable compound to measure the oscillation peak intensity by the FT-IR method. The characteristic oscillation peak intensity (peak height or peak area) of the charge transportable compound is preferably used as the oscillation peak intensity, and an oscillation peak intensity from carbonyl having low reactivity and a known content is more preferably used.

The method of measuring the content of the charge transportable compound in the surface layer is specifically explained.

First, the method of making the calibration curve is explained.

When an area calculated from an oscillation peak intensity from carbonyl in the surface layer the charge transportable compound is not added to is $\alpha 0$, an area calculated from an oscillation peak intensity from carbonyl in the surface layer the charge transportable compound is added to is $\beta 0$, and areas calculated from each oscillation peak intensity when the charge transportable compound is added to the surface layer in an amount of 20, 40 and 60% by weight are $\alpha 20$, $\alpha 40$ and $\alpha 60$, and $\beta 20$, $\beta 40$ and $\beta 60$, the oscillation intensity ratio ($\beta x/\alpha x$) and the content of the charge transportable compound are plotted to make the calibration curve.

Next, the oscillation intensity ratio is measured by an ATR method of the FT-IR to calculate the content of the charge transportable compound, based on the calibration curve. When the content of the charge transportable compound in the surface layer is measured, known etching methods or microtome is used to expose a part of the layer where the content is measured.

Specific examples of the plasticizer include, but are not limited to, dibutylphthalate and dioctylphthalate. These can be used alone or in combination. The content of the plasticizer is preferably from 0 to 30 parts by weight per 100 parts by weight of the resin having no charge transportability.

Specific examples of the leveling agent include, but are not limited to, silicone oils such as dimethylsilicone oil and methylphenylsilicone oil; and polymers or oligomers having a perfluoroalkyl group in the side chain. The content of the leveling agent is preferably from 0 to 1 part by weight per 100 parts by weight of the resin having no charge transportability.

Specific examples of methods forming the surface layer include, but are not limited to, a method of coating a coating liquid including the resin having no charge transportability, the zinc oxide doped with a boron group and the additive on the photosensitive layer of the electrophotographic photoreceptor, drying the liquid upon application of heat to cure.

Methods of coating the coating liquid are not particularly limited, and can be selected according to a viscosity of the coating liquid and a thickness of the surface layer. Specific examples thereof include, but are not limited to dip coating methods, spray coating methods, bead coating methods and ring coating methods.

The coating liquid is preferably formed by dissolving the materials in a solvent because it is a solid or high-viscosity liquid at room temperature. The solvent is not particularly limited, if the above materials can be dissolved or dispersed therein. Specific examples there of include, alcohols such as methanol, ethanol, propanol and butanol; ketones such as acetone, methyl ethyl ketone, methyl isobutyl ketone and cyclohexanone; esters such as ethylacetate and butylacetate; ethers such as tetrahydrofuran, dioxane and propylether; halogens such as dichloromethane, dichloroethane, trichloroethane and chlorobenzene; aromatics such as benzene, toluene and xylene; and cellosolves such as methylcellosolve, ethylcellosolve and cellosolve acetate. These solvents can be used alone or in combination.

In order to remove the solvent, the surface layer is preferably heated and dried after formed.

Specific examples of the heating method include, but are not limited to, methods of applying a heat energy such as air, a gaseous body such as nitrogen, a steam, a variety of heating media, infrared or an electromagnetic wave to the layer from the coated side or from the electroconductive substrate. The heating temperature is preferably from 100 to 170° C. When less than 100° C., the solvent is likely to remain in the surface layer too much, resulting in occasional deterioration of properties of the electrophotographic photoreceptor. When higher than 170° C., low-molecular-weight components in the photosensitive layer next to the surface layer are likely to transfer into the surface layer, resulting in possible deterioration of the surface resistivity control and other properties.

The surface layer preferably has a thickness not greater than 10 μm, and more preferably not greater than 8 μm in terms of good image resolution and responsivity. The minimum thickness is preferably not less than 3 μm in terms of chargeability and abrasion resistance, although depending on the system, particularly potential.

The photosensitive layer may be single-layered or a multi-layered.

The single-layered photosensitive layer has charge generatability and charge transportability at the same time. The photosensitive layer includes a charge generation material (CGM), a charge transport material (CTM) and a binder resin, and other components such as a plasticizer, a leveling agent and antioxidant when necessary.

The CGM is not particularly limited, and the same materials included in the multi-layered photosensitive layer mentioned later can be used. The content of the CGM is preferably from 5 to 40 parts by weight per 100 parts by weight of the binder resin.

The CTM is not particularly limited, and the same materials included in the multi-layered photosensitive layer mentioned later can be used. The content of the CTM is preferably not greater than 190 parts by weight, and more preferably from 50 to 150 parts by weight per 100 parts by weight of the binder resin.

The binder resin is not particularly limited, and the same binder resins included in the multi-layered photosensitive layer mentioned later can be used.

Specific examples of methods forming the single-layered photosensitive layer include, but are not limited to, dissolving or dispersing a CGM, a CTM, a binder resin and other components such as a plasticizer, a leveling agent and antioxidant when necessary by a disperser in a solvent such as tetrahydrofuran, dioxane, dichloroethane and cyclohexane to prepare a coating liquid; and coating the coating liquid and drying.

Specific examples of the coating method include, but are not limited to dip coating methods, spray coating methods, bead coating methods and ring coating methods.

The single-layered photosensitive layer preferably has a thickness of from 5 to 25 μm.

The multi-layered photosensitive layer includes at least a charge generation layer (CGL) and a charge transport layer (CTL) in this order because charge generatability and charge transportability are independently borne thereby, and other layers when necessary. Known CGL, CTL and other layers can be used.

The order of the CGL and the CTL is not particularly limited, but the CTL is preferably formed on the CGL because the CGM typically has poor chemical stability and causes deterioration of charge generation when exposed to an oxidizing gas produced around a charger.

The CGL includes a CGM and preferably a binder resin, and the other components such as an antioxidant when necessary.

Specific examples of the CGM include, but are not limited to, an inorganic material and an organic material.

Specific examples of the inorganic material include, but are not limited to, crystalline selenium, amorphous selenium, selenium-tellurium alloys, selenium-tellurium-halogen alloys, selenium-arsenic alloys and amorphous silicone. The amorphous silicone prepared by terminating a dangling bond with a hydrogen atom or a halogen atom, or doping a boron atom or a phosphorus atom.

Specific examples of the organic materials include, but are not limited to, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments, etc. These charge generation materials can be used alone or in combination.

Specific examples of the binder resin optionally used in the CGL include, but are not limited to, polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

In addition, a charge transportable polymeric material having charge transportability can also be used as the binder resin in the CGL besides the above-mentioned binder resins. Specific examples thereof include polymeric materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the other components include, but are not limited to, a low-molecular-weight charge transport material, a solvent and a leveling agent. The antioxidant may be included.

The content thereof is preferably from 0.01 to 10% by weight per 100% by weight of the CGL.

The low-molecular-weight charge transport materials include positive hole transport materials and electron transport materials.

Specific examples of the electron transport materials include, but are not limited to, electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include, but are not limited to, electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate and butyl acetate. These can be used alone or in combination.

Specific examples of the leveling agent include, but are not limited to, silicone oils such as dimethylsilicone oil and methylphenyl silicone oil. These can be used alone or in combination.

Specific examples of methods forming the CGL include, but are not limited to, dissolving or dispersing the CGM, the binder resin and the other components in the solvent to prepare a coating liquid; and coating and drying the liquid on an electroconductive substrate. The coating liquid can be coated by a casting method.

The CGL preferably has a thickness of from 0.01 to 5 μm, and more preferably from 0.05 to 2 μm.

The CTL maintains a charge and transports a charge generated by irradiation in the CGL to combine with the charge maintained. To maintain the charge, the CTL needs to have high electrical resistance. To obtain high surface potential, the CTL needs to have small permittivity and good charge transportability.

The CTL includes a CTM and preferably a binder resin, and the other components such as an antioxidant when necessary.

Specific examples of the CTM include, but are not limited to, positive hole transport materials, electron transport materials and a polymeric CTM.

The CTL preferably includes the CTM in an amount of from 20 to 80% by weight, and more preferably from 30 to 70% by weight. When less than 20% by weight, the CTL occasionally does not have desired light attenuation. When greater than 80% by weight, CTL is occasionally abraded more than necessary due to various hazards in the image forming process. The electrophotographic photoreceptor has desired light attenuation and is less abraded when the CTL includes the CTM in a preferred amount.

Specific examples of the electron transport materials include, but are not limited to, electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive-hole transport materials include, but are not limited to, oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. These positive-hole transport materials can be used alone or in combination.

The polymeric CTM has a binder resin function and a charge transport material function. Particularly when an amorphous oxide is used in an intermediate layer, the polymeric CTM used as a CTM prevents deterioration of chargeability and production of images having background fouling.

Specific examples of the polymeric CTM include, but are not limited to, a polymer having a carbazole ring, a polymer having a hydrazone structure, a polysilylene polymer, a polymer having a triarylamine structure, a polymer having an electron donating group and other polymers. These can be used alone or in combination, and may be combined with a binder resin mentioned later in terms of abrasion resistance and layer formability.

The CTL preferably includes the polymeric CTM in an amount of from 40 to 90% by weight, and more preferably from 50 to 80% by weight in terms of charge transportability when combined with the binder resin.

Specific examples of the binder resin include, but are not limited to, polycarbonate resins, polyester resins, methacrylic reins, acrylic resins, polyethylene resins, polyvinylchloride resins, polyvinylacetate resins, polystyrene resins, phenolic resins, epoxy resins, polyurethane resins, polyvinylidenechloride resins, alkyd resins, silicone resins, polyvinylcarbazole resins, polyvinylbutyral resins, polyvinylformal resins, polyacrylate resins, polyacrylamide resins and phenoxy resins. These can be used alone or in combination.

The CTL may include a copolymer of a crosslinkable binder resin and a crosslinkable CTM.

Specific examples of the other components include, but are not limited to, a solvent, a plasticizer and a leveling agent. The antioxidant may be included.

The content thereof is preferably from 0.01 to 10% by weight per 100% by weight of the CTL.

Specific examples of the solvent include, but are not limited to, the same solvents used in the CGL. Solvents dissolving the CTM and the binder resin well are preferably used. These can be used alone or in combination.

Specific examples of the plasticizer include, but are not limited to, typical resin plasticizers such as dibutylphthalate and dioctylphthalate.

Specific examples of the leveling agent include, but are not limited to, silicone oils such as dimethylsilicone oil and methylphenylsilicone oil; and polymers or oligomers having a perfluoroalkyl group in the side chain.

Specific examples of methods forming the CTL include, but are not limited to, dissolving or dispersing the CGM, the binder resin and the other components in the solvent to prepare a coating liquid; and coating and drying the liquid on the CGL.

Methods of coating the coating liquid are not particularly limited, and can be selected according to a viscosity of the coating liquid and a thickness of the CTL. Specific examples thereof include, but are not limited to dip coating methods, spray coating methods, bead coating methods and ring coating methods.

The CTL needs heating to remove the solvent therefrom.

Specific examples of the heating method include, but are not limited to, methods of applying a heat energy such as air, a gaseous body such as nitrogen, a steam, a variety of heating media, infrared or an electromagnetic wave to the layer from the coated side or from the electroconductive substrate.

The heating temperature is preferably from 100 to 170° C. When less than 100° C., the solvent in the CTL is not fully removed, resulting in deterioration of electrophotographic properties and abrasion resistance. When higher than 170° C., the CTL not only has defects and cracks on the surface and peels from the other layers, but also the photoreceptor does not have desired electrical properties when volatile components in the CTL vapors.

The CTL preferably has a thickness not greater than 50 μm, and more preferably not greater than 45 μm in terms of good image resolution and responsivity. The minimum thickness is preferably not less than 5 μm in terms of chargeability and abrasion resistance, although depending on the system, particularly potential.

Specific examples of the other layers include, but are not limited to, an undercoat layer and an intermediate layer.

The undercoat layer may be formed between the electroconductive substrate and the CGL.

The undercoat layer includes a resin, and other components such as an antioxidant, a fine powder pigment and a coupling agent when necessary.

Specific examples of the resin include, but are not limited to, water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins and epoxy resins.

It is desirable that these resins, when it is conceivable that a photosensitive layer is coated thereon with a solvent, have high solvent resistance against general organic solvents.

Specific examples of the fine powder pigment include, but are not limited to, pigments preventing moire and decreasing a residual potential such as titanium oxide, silica, alumina, zirconium oxide, tin oxide and indium oxide Specific examples of the coupling agent include, but are not limited to, a silane coupling agent, a titanium coupling agent and a chromium coupling agent.

The undercoat layer may be single-layered or multi-layered.

Specific examples of method forming the undercoat layer include, but are not limited to, subjecting $Al_2O_3$ to anode oxidation; and subjecting an organic substance such as polyparaxylylene (parylene) or an inorganic substance such as $SiO_2$, $SnO_2$, $TiO_2$, ITO or $CeO_2$ to vacuum film making.

The undercoat layer preferably has a thickness of from 1 to 15 μm.

The intermediate layer may be formed between the CTL and the surface layer to prevent a charge transport component from mixing in the surface layer and improve adhesiveness therebetween.

The intermediate layer is preferably insoluble or hardly-soluble in the surface layer coating liquid, and includes a binder resin and other components such as an antioxidant when necessary.

Specific examples of the binder resin include, but are not limited to, polyamides, alcohol-soluble nylons, water-soluble polyvinyl butyral, polyvinyl butyral and polyvinyl alcohol.

The intermediate layer can be formed by one of the above-mentioned known coating methods.

The intermediate layer preferably has a thickness of from 0.05 to 2 μm.

The electroconductive substrate is not particularly limited, and includes any materials having a volume resistance not greater than $10^{10}$ Ω·cm. Further, endless belts of a metal such as nickel and stainless steel, which have been disclosed in Japanese published unexamined application No. JP-S52-36016-A can be also used.

Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate.

An electroconductive layer may be formed on the electroconductive substrate.

Specific examples of methods forming the electroconductive layer include, but are not limited to, a method of dispersing or dissolving an electroconductive powder and a binder resin in a solvent when necessary to prepare a coating liquid and coating the liquid on the electroconductive substrate; and a method of using a heat contraction tube including the electroconductive powder and a material such as polyvinylchloride, polypropylene, polyester, polystyrene, polyvinylidene, polyethylene, rubber chloride and Teflon (registered trade name).

Specific examples of the electroconductive powder include, but are not limited to, carbon powders such as carbon black and acetylene black; metallic powders such as aluminium, nickel, iron, nichrome, copper, zinc, and silver; or metallic oxides such as electroconductive titanium oxide, electroconductive tin oxide and ITO.

Specific examples of the binder resins include, but are not limited to, thermoplastic resins, thermosetting resins or photo-curing resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins.

Specific examples of the solvent include, but are not limited to, tetrahydrofuran, dichloromethane, methyl ethyl ketone and toluene.

FIG. 1 is a schematic view illustrating an embodiment of the layer structure of the electrophotographic photoreceptor of the present invention, in which a single-layered photosensitive layer 26 and surface layer 25 are formed on an electroconductive substrate 21 in this order.

Figure 2:
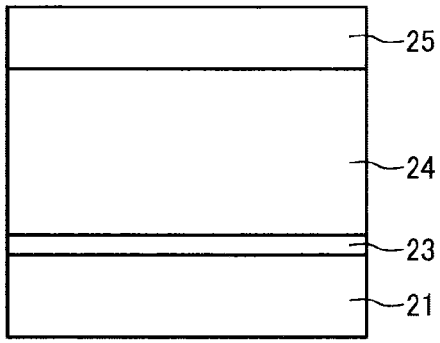
FIG. 2 is a schematic view illustrating another embodiment of the layer structure of the electrophotographic photoreceptor of the present invention.

FIG. 2 is a schematic view illustrating another embodiment of the layer structure of the electrophotographic photoreceptor of the present invention, in which a CGL 23, a CTL 24 and a surface layer 25 are formed on an electroconductive substrate 21 in this order. The CGL 23 and the CTL 24 form a multi-layered photosensitive layer.

Figure 3:
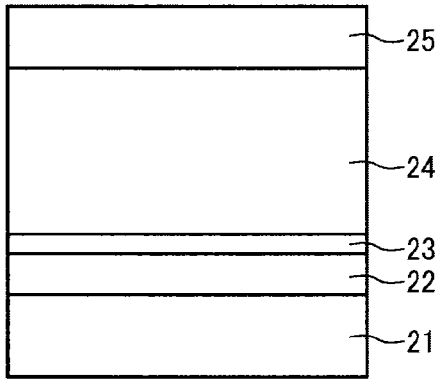
FIG. 3 is a schematic view illustrating a further embodiment of the layer structure of the electrophotographic photoreceptor of the present invention.

FIG. 3 is a schematic view illustrating a further embodiment of the layer structure of the electrophotographic photoreceptor of the present invention, which further includes an intermediate layer in addition to the layer structure in FIG. 2. An intermediate layer 22, a CGL 23, a CTL 24 and a surface layer 25 are formed on an electroconductive substrate 21 in this order. The CGL 23 and the CTL 24 form a multi-layered photosensitive layer.

Figure 4:
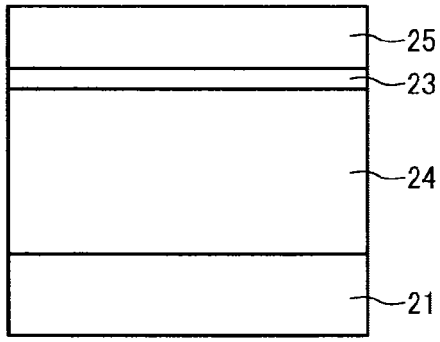
FIG. 4 is a schematic view illustrating another embodiment of the layer structure of the electrophotographic photoreceptor of the present invention.

FIG. 4 is a schematic view illustrating another embodiment of the layer structure of the electrophotographic photoreceptor of the present invention, in which a CTL 24, a CGL 23 and a surface layer 25 are formed on an electroconductive substrate 21 in this order. The CGL 23 and the CTL 24 form a multi-layered photosensitive layer.

The image forming method of the present invention includes at least a charging process, an irradiation process, a developing process and a transfer process, and other processes when necessary. An electrophotographic photoreceptor used in the image forming method is the electrophotographic photoreceptor of the present invention. A combination of the charging process and the irradiation process is expediently called as an electrostatic latent image forming process.

The image forming apparatus of the present invention includes at least a charger, an irradiator, an image develop and a transferer, and other means when necessary. An electrophotographic photoreceptor used in the image forming apparatus is the electrophotographic photoreceptor of the present invention. A combination of the charger and the irradiator is expediently called as an electrostatic latent image former.

The image forming method is performed by the image forming apparatus, the charging process by the charger, the irradiation process by the irradiator, the developing process by the image developer, the transfer process by the transferer, and the other processes by the other means.

The charging process is a process of charging the surface of the electrophotographic photoreceptor, which is performed by the charger.

Specific examples of the charger include, but are not limited to, known contact chargers including an electroconductive or semi-conductive roll, brush, film or rubber blade; and non-contact chargers located close to the electrophotographic photoreceptor with a gap not longer than 100 μm therebetween, using corona discharge such as corotron and scorotron.

The irradiating process is a process of irradiating the charged surface of the electrophotographic photoreceptor, which is performed by the irradiator.

The irradiator is not particularly limited, and can be selected from any irradiators if it can irradiate the charged surface of the electrophotographic photoreceptor imagewise. Specific examples thereof include various irradiators such as reprographic optical irradiators, rod lens array irradiators, laser optical irradiators, liquid crystal shutter optical irradiators and LED optical irradiators. Specific examples of the light sources for use in the irradiators include light emitting diodes (LEDs), laser diodes (LDs) and electroluminescence devices (ELs). In the present invention, it is possible to irradiate the electrophotographic photoreceptor from the backside thereof.

The developing process is a process of developing the electrostatic latent image with a toner to form a visible image, which is performed by the image developer.

The image developer is not particularly limited, and can be selected from any image developers if it can develop with the toner or a developer. The image developer includes a developing unit adapted to store and supply the toner or the developer to the electrostatic latent image with or without contacting the electrostatic latent image. The image developer may employ either a dry developing method or a wet developing method. The image developer may be either a single-color image developer or a multi-color image developer. The image developer may be comprised of an agitator for frictionally agitating and charging the developer and a rotatable magnet roller. Toner particles and carrier particles are mixed and agitated within the image developer so that the toner particles are frictionally charged. The charged toner particles and carrier particles are borne on the surface of the magnet roller forming chainlike aggregations (hereinafter "magnetic brush"). The magnet roller is disposed adjacent to the electrophotographic photoreceptor. Therefore, a part of the toner particles in the magnetic brush migrates from the surface of the magnet roller to the surface of the electrophotographic photoreceptor due to electrical attractive force. As a result, the electrostatic latent image formed on the electrophotographic photoreceptor is developed with the toner to form a visual image.

The transfer is a process of transferring the visual image to a recording medium, which is performed by the transferer.

The transfer methods include a method of directly transferring the visual image onto a recording medium and another method of first transferring the visual image onto an intermediate transferer and secondly transferring the visual image onto a recording medium. The former (direct) transfer method is preferably used when the transfer causes an adverse effect for producing quality images. The transfer is performed by charging the electrophotographic photoreceptor with a transfer charger.

Specific examples of the other processes and means include, but are not limited to, a fixing process and a fixer, a discharge process and a discharger, a cleaning process and a cleaner, a recycle process and a recycler, and a control process and a controller.

The fixing process is a process of fixing the transfer image on a recording medium, which is performed by the fixer.

Specific examples of the fixer include, but are not limited to, a combination of a heating roller and a pressing roller, or a combination of a heating roller, a pressing roller, and an endless belt. The heating roller preferably has a temperature of from 80 to 200° C. In the fixing process, an optical fixer can be used in place of or in combination with the fixer. Each color toner may be fixed or layered color toners may be fixed together.

The discharge process is a process of applying a discharge bias to the electrophotographic photoreceptor to be discharged, which is performed by the discharger.

The discharger is not particularly limited, and can be selected from known dischargers if it can apply a discharge bias to the electrophotographic photoreceptor such as a discharge lamp.

The cleaning process is a process of removing the toner remaining on the electrophotographic photoreceptor, which is performed by the cleaner. The cleaner is not particularly limited, and can be selected from known cleaners if it can remove the toner remaining on the electrophotographic photoreceptor such as a magnetic brush cleaner, an electrostatic brush cleaner, a magnetic roller cleaner, a blade cleaner, a brush cleaner and a web cleaner.

The recycle process is a process of recycling the removed toner in the cleaning process to the image developer, which is performed by the recycler. The recycler is not particularly limited, and can be selected from known conveyers.

The control process is a process of controlling the above-described processes, performed by the controller. The controller is not particularly limited, and can be selected from controllers such as a sequencer and a computer.

Figure 5:
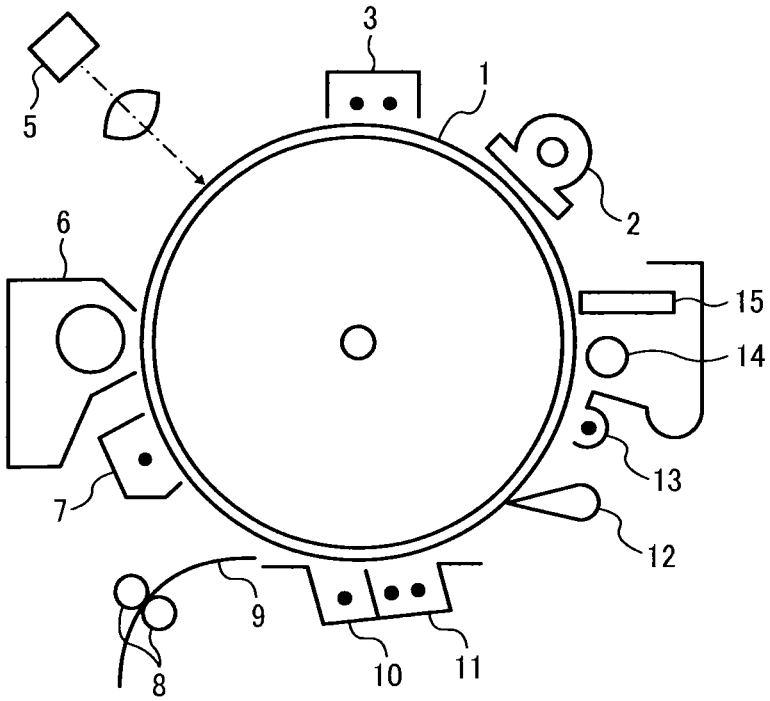
FIG. 5 is a schematic view illustrating an embodiment of the image forming apparatus of the present invention.

FIG. 5 is a schematic view illustrating an embodiment of the image forming apparatus of the present invention. Around the electrophotographic photoreceptor 1, a charger 3, an irradiator 5, an image developer 6 and a transferer 10 are located.

First, the electrophotographic photoreceptor 1 is uniformly charged. As the charger 3, known chargers such as a corotron device, a scorotron device, a solid discharge element, a needle electrode device, a roller charging device and an electroconductive brush device.

Next, an electrostatic latent image is formed on the uniformly charged electrophotographic photoreceptor 1 by the irradiator 5. Specific examples of light sources for use in the charger 3 include any known light emitters such as fluorescent lamps, tungsten lamps, halogen lamps, mercury lamps, sodium lamps, light emitting diodes (LEDs), laser diodes (LDs) and electroluminescent lamps (ELs). In order to irradiate only light having a wavelength in a desired range, various filters such as sharp cut filters, bandpass filters, infrared cut filers, dichroic filters, interference filters and color temperature converting filters can be used.

The electrostatic latent image formed on the electrophotographic photoreceptor 1 is visualized by the image developer 6. The developing methods include a one-component developing method and a two-component developing method using a dry toner; and a wet developing method using a wet toner. When the electrophotographic photoreceptor 1 positively (or negatively) charged is exposed to imagewise light, an electrostatic latent image having a positive (or negative) charge is formed thereon. When the latent image having a positive (or negative) charge is developed with a toner having a negative (or positive) charge, a positive image can be obtained. In contrast, when the latent image having a positive (negative) charge is developed with a toner having a positive (negative) charge, a negative image can be obtained.

Next, a toner image visualized on the electrophotographic photoreceptor 1 is transferred onto a recording medium 9 by the transferer 10. A pre-transfer charger 7 may be used to improve transfer performance. Specific examples of the transferer 10 include, but are not limited to, transferers using electrostatic transfer methods such as a transfer charger and a bias roller; mechanical transferers using methods such as an adhesive transfer method and a pressure transfer method; and magnetic transferers.

Further, a separation charger 11 and a separation click 12 may be used to separate the recording medium 9 from the electrophotographic photoreceptor 1. Other separation means include an electrostatic adsorption induction separator, a side edge belt separator, an end grip conveyer, a curvature separator, etc. The above-mentioned chargers can be used as the separation charger 11. In order to clean a toner remaining on the photoreceptor after transferred, a cleaner such as a fur brush 14 and a cleaning blade 15 is used. And a pre-cleaning charger 13 may be used to more efficiently perform cleaning. Other cleaners include a web cleaner, a magnet brush, etc. These can be sued alone or in combination. In order to remove a residual potential on the electrophotographic photoreceptor 1, a discharger 2 may be used. A discharge lamp or a discharge charger is used as the discharger 2, and the above-mentioned light sources and chargers can be used. In other processes which are not close to the electrophotographic photoreceptor, known means can be used.

The image forming method and the image forming apparatus of the present invention use the electrophotographic photoreceptor of the present invention.

The process cartridge of the present invention is detachable from image forming apparatus, including at least the electrophotographic photoreceptor of the present invention and one of a charger charging the electrophotographic photoreceptor, an image developer transferring a toner on an electrostatic latent image formed on the surface of the electrophotographic photoreceptor, a transferer transferring the toner adhering thereto to a recording medium, a cleaner removing the toner remaining thereon after transferred and a discharger discharging electrophotographic photoreceptor after the toner is transferred, and may include other means when necessary.

Figure 6:
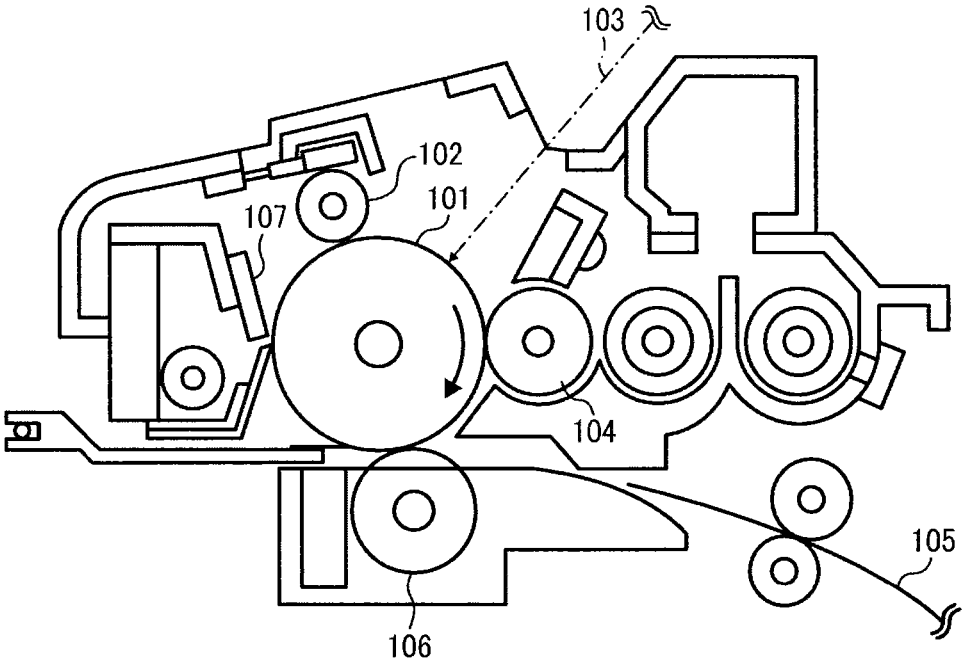
FIG. 6 is a schematic view illustrating an embodiment of the process cartridge of the present invention.

As shown in FIG. 6, the process cartridge is a device (component) detachable from image forming apparatus, including an electrophotographic photoreceptor 101, and one of a charger 102, an image developer 104, a transferer 106, a cleaner 107 and a discharger (not illustrated). The photoreceptor 102 is charged by the charger 102 and irradiated by an irradiator 103 while rotating to form an electrostatic latent image on its surface. The electrostatic latent image is developed by the image developer 104 with a toner to form a toner image. The toner image is transferred by the transferer 106 to a recording medium 105, and printed out. Then, the surface of the photoreceptor is cleaned by the cleaner 107, and further discharged by discharger (not illustrated). These operations are repeated.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

An undercoat coating liquid, a charge generation coating liquid and charge transport coating liquid, which have the following compositions, were coated and dried in this order on an aluminum cylinder having a diameter of 40 mm to form an undercoat layer, a charge generation layer and a charge transport layer having thickness of 3.5 μm, 0.2 μm and 20 μm, respectively thereon.

[Undercoat Layer Coating Liquid]

| | |
|---|---|
| Alkyd resin (BECKOSOL 1307-60-EL from Dainippon Ink And Chemicals, Inc.) | 12 |
| Melamine resin (Super Beckamine G821-60 from Dainippon Ink And Chemicals, Inc.) | 8 |
| Titanium oxide (CR-EL from Ishihara Sangyo Kaisha Ltd.) | 80 |
| Methyl ethyl ketone | 250 |

[CGL Coating Liquid]

| | |
|---|---|
| Bisazo pigment having the following formula (1) | 2.5 |

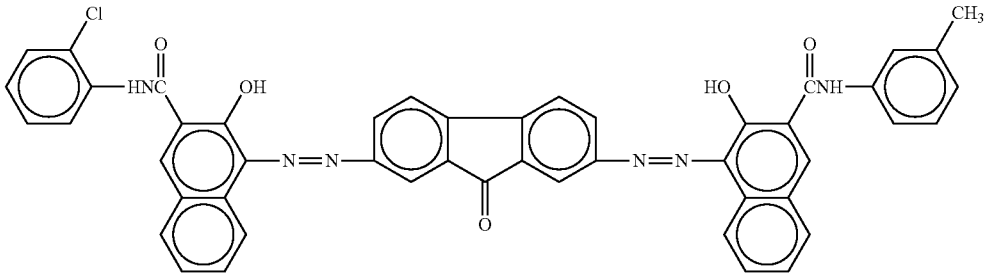

(1)

-continued

| | |
|---|---|
| Polyvinylbutyral (XYHL from Union Carbide Corp.) | 0.5 |
| Cyclohexanone | 200 |
| Methyl ethyl ketone | 80 |

[CTL Coating Liquid]

| | |
|---|---|
| Z-type polycarbonate (Panlite TS-2050 from TEIJIN CHEMICALS LTD.) | 10 |
| Charge transportable compound having the following formula (2): | 7 |

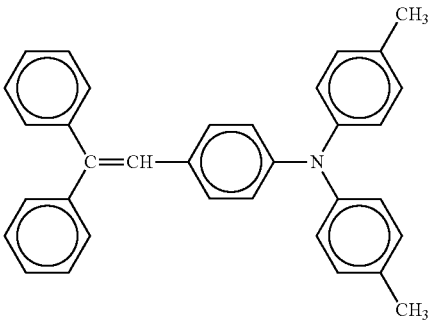

(2)

| | |
|---|---|
| Tetrahydrofuran | 100 |
| 1% silicone oil solution in tetrahydrofuran (KF50-100CS from Shin-Etsu Chemical Industry Co., Ltd.) | 1 |

Next, a surface layer coating liquid having the following composition was coated on a layered body including the electroconductive substrate, undercoat layer, the CGL and the CTL in this order by spray coating to from a surface layer having a thickness of 4.5 μm thereon, and heated at 150° C. for 30 min to prepare an electrophotographic photoreceptor.

The surface layer coating liquid was prepared by placing zinc oxide doped with aluminum, a surfactant and cyclohexanone in a container having a capacity of 50 mL including 110 g of zirconia beads having an average particle diameter of 0.1 mm; oscillating the mixture at 1,500 rpm for 2 hrs to prepare a dispersion in which zinc oxide doped with aluminum was dispersed; placing the dispersion in a container having a capacity of 50 mL including 60 g of zirconia beads having an average particle diameter of 5 mm and oscillating the dispersion at 200 rpm for 24 hrs to prepare a mill base; and placing the mill base in a tetrahydrofuran solution in which bisphenol Z polycarbonate to prepare a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with aluminum (Pazet CK having an average particle diameter of 35 nm from Hakusuitech, Ltd.) | 33.3 |
| Surfactant (Polymer of low-molecular-weight unsaturated polycarboxylic acid BYK-P105 from BYK-Chemie GmbH) | 1.7 |
| Tetrahydrofuran | 711 |
| Cyclohexanone | 178 |

Example 2

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with aluminum (Pazet CK having an average particle diameter of 35 nm from Hakusuitech, Ltd.) | 53.8 |
| Surfactant (BYK-P105 from BYK-Chemie GmbH) | 2.7 |
| Tetrahydrofuran | 821 |
| Cyclohexanone | 205 |

Example 3

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with aluminum (Pazet CK having an average particle diameter of 35 nm from Hakusuitech, Ltd.) | 100 |
| Surfactant (BYK-P105 from BYK-Chemie GmbH) | 5.0 |
| Tetrahydrofuran | 1,067 |
| Cyclohexanone | 267 |

Example 4

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with aluminum (Pazet CK having an average particle diameter of 35 nm from Hakusuitech, Ltd.) | 150 |
| Surfactant (BYK-P105 from BYK-Chemie GmbH) | 7.5 |
| Tetrahydrofuran | 1,333 |
| Cyclohexanone | 333 |

Example 5

The procedure for preparation of the electrophotographic photoreceptor in Example 1 was repeated to prepare an electrophotographic photoreceptor except for replacing zinc oxide doped with aluminum with zinc oxide doped with gallium (Pazet GK-40 having an average particle diameter of 32 nm from Hakusuitech, Ltd.).

Example 6

The procedure for preparation of the electrophotographic photoreceptor in Example 2 was repeated to prepare an electrophotographic photoreceptor except for replacing zinc oxide doped with aluminum with zinc oxide doped with gallium (Pazet GK-40 having an average particle diameter of 32 nm from Hakusuitech, Ltd.).

Example 7

The procedure for preparation of the electrophotographic photoreceptor in Example 3 was repeated to prepare an electrophotographic photoreceptor except for replacing zinc oxide doped with aluminum with zinc oxide doped with gallium (Pazet GK-40 having an average particle diameter of 32 nm from Hakusuitech, Ltd.).

Example 8

The procedure for preparation of the electrophotographic photoreceptor in Example 4 was repeated to prepare an electrophotographic photoreceptor except for replacing the zinc oxide doped with aluminum with zinc oxide doped with gallium (Pazet GK-40 having an average particle diameter of 32 nm from Hakusuitech, Ltd.).

Example 9

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Charge transportable compound having the following formula (2): | 10 |

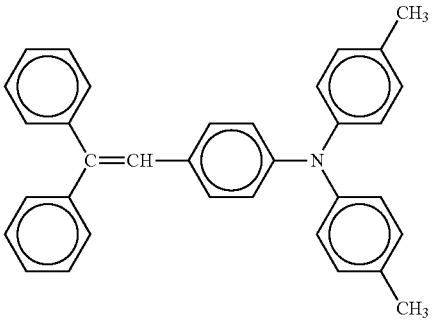

(2)

| | |
|---|---|
| Zinc oxide doped with gallium (Pazet GK-40 having an average particle diameter of 32 nm from Hakusuitech, Ltd.) | 110 |
| Surfactant (BYK-P105 from BYK-Chemie GmbH) | 5.5 |
| Tetrahydrofuran | 1,173 |
| Cyclohexanone | 293 |

Example 10

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Charge transportable compound having the following formula (2): | 20 |

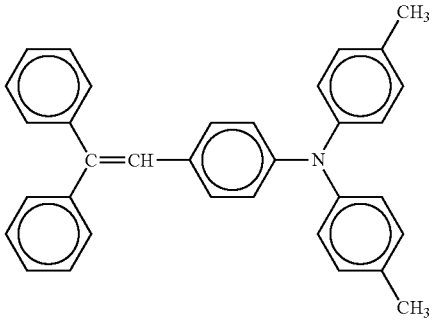

(2)

| | |
|---|---|
| Zinc oxide doped with gallium (Pazet GK-40 having an average particle diameter of 32 nm from Hakusuitech, Ltd.) | 120 |
| Surfactant (BYK-P105 from BYK-Chemie GmbH) | 6.0 |
| Tetrahydrofuran | 1,280 |
| Cyclohexanone | 320 |

Example 11

The procedure for preparation of the electrophotographic photoreceptor in Example 1 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 12

The procedure for preparation of the electrophotographic photoreceptor in Example 2 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 13

The procedure for preparation of the electrophotographic photoreceptor in Example 3 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 14

The procedure for preparation of the electrophotographic photoreceptor in Example 4 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 15

The procedure for preparation of the electrophotographic photoreceptor in Example 5 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 16

The procedure for preparation of the electrophotographic photoreceptor in Example 6 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 17

The procedure for preparation of the electrophotographic photoreceptor in Example 7 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 18

The procedure for preparation of the electrophotographic photoreceptor in Example 8 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 19

The procedure for preparation of the electrophotographic photoreceptor in Example 9 was repeated to prepare an electrophotographic photoreceptor except for replacing the charge transportable compound with a charge transportable compound having the following formula (3):

(3)

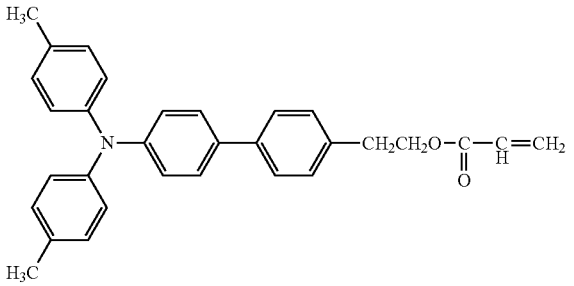

and 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 20

The procedure for preparation of the electrophotographic photoreceptor in Example 10 was repeated to prepare an electrophotographic photoreceptor except for replacing the charge transportable compound with a charge transportable compound having the following formula (3):

(3)

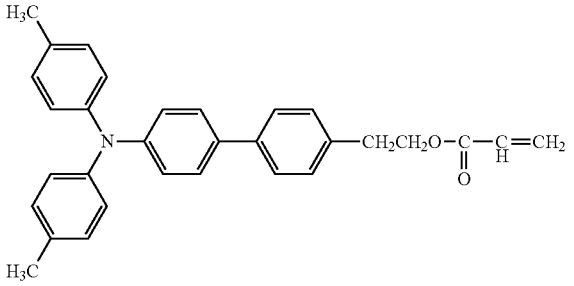

and 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxycyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 mW/cm$^2$ for 120 sec to be crosslinked while rotating the layered body to form a surface layer, and drying the surface layer at 130° C. for 30 min.

Example 21

The procedure for preparation of the electrophotographic photoreceptor in Example 12 was repeated to prepare an electrophotographic photoreceptor except for replacing zinc oxide doped with aluminum (Pazet CK having an average particle diameter of 35 nm from Hakusuitech, Ltd.) with zinc oxide doped with aluminum (23-K having an average particle diameter of 152 nm from Hakusuitech, Ltd.).

Example 22

The procedure for preparation of the electrophotographic photoreceptor in Example 13 was repeated to prepare an electrophotographic photoreceptor except for replacing zinc oxide doped with aluminum (Pazet CK having an average particle diameter of 35 nm from Hakusuitech, Ltd.) with zinc oxide doped with aluminum (23-K having an average particle diameter of 152 nm from Hakusuitech, Ltd.).

Example 23

The procedure for preparation of the electrophotographic photoreceptor in Example 17 was repeated to prepare an electrophotographic photoreceptor except for replacing 100 parts of trimethylolpropanetriacrylate (TMPTA from Tokyo Chemical Industry Co., Ltd.) with 40 parts thereof and 60 parts of a compound having the following formula (4) (bisphenol A acrylate monomer from Sartomer Company Inc.).

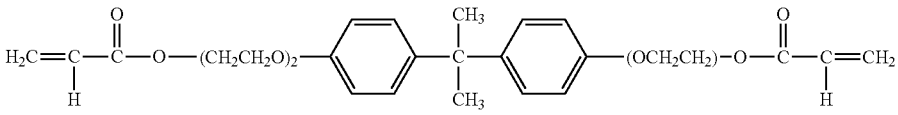

(4)

Example 24

The procedure for preparation of the electrophotographic photoreceptor in Example 17 was repeated to prepare an electrophotographic photoreceptor except for replacing 100 parts of trimethylolpropanetriacrylate (TMPTA from Tokyo Chemical Industry Co., Ltd.) with 80 parts thereof and 20 parts of a compound having the following formula (5) (caprolactone-modified dipentaerythritolhexaacrylate from NIPPON KAYAKU Co., Ltd.).

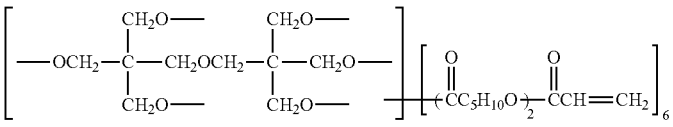

(5)

Example 25

The procedure for preparation of the electrophotographic photoreceptor in Example 3 was repeated to prepare an electrophotographic photoreceptor except for replacing bisphenol Z polycarbonate in the surface layer coating liquid with a polyarylate resin (U-100 from UNITIKA LTD.).

Example 26

The procedure for preparation of the electrophotographic photoreceptor in Example 3 was repeated to prepare an electrophotographic photoreceptor except for replacing bisphenol Z polycarbonate in the surface layer coating liquid with a styrene resin (SEPTON 2043 from KURARAY CO., LTD.).

Example 27

The procedure for preparation of the electrophotographic photoreceptor in Example 3 was repeated to prepare an electrophotographic photoreceptor except for replacing bisphenol Z polycarbonate in the surface layer coating liquid with a phenol resin (PR9480 from SUMITOMO BAKELITE CO., LTD.)

Example 28

The procedure for preparation of the electrophotographic photoreceptor in Example 3 was repeated to prepare an electrophotographic photoreceptor except for replacing bisphenol Z polycarbonate in the surface layer coating liquid with a rein obtained from a reaction between a polyol compound having the following formula (6) and an isocyanate compound (Takenate D140N from Mitsui Takeda Chemicals. Inc.) such that OH value/NIC value is 1.0.

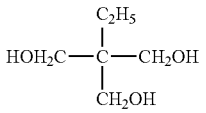

(6)

Example 29

The procedure for preparation of the electrophotographic photoreceptor in Example 3 was repeated to prepare an electrophotographic photoreceptor except for replacing bisphenol Z polycarbonate in the surface layer coating liquid with a compound prepared by the following method.

A liquid including 10 parts of trimethoxysilane, 5 parts of 1% solution of acetate and 15 parts of n-butanol were stirred at 60° C. for 2 hrs to prepare a mixture, and 0.016 parts of $nBu2.Sn(OAc)_2$ were added to the mixture and the mixture was stirred at 40° C. for 3 hrs.

Example 31

The procedure for preparation of the electrophotographic photoreceptor in Example 2 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with aluminum (Pazet CK having an average particle diameter of 35 nm from Hakusuitech, Ltd.) | 43.8 |
| Fluorine-containing resin (MPE-056 from Du Pont-Mitsui Fluorochemicals Co., Ltd) | 10 |
| Surfactant (BYK-P105 from BYK-Chemie GmbH) | 2.7 |
| Tetrahydrofuran | 821 |
| Cyclohexanone | 205 |

Example 32

The procedure for preparation of the electrophotographic photoreceptor in Example 2 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with gallium (Pazet GK-40 having an average particle diameter of 32 nm from Hakusuitech, Ltd.) | 43.8 |
| Fluorine-containing resin (MPE-056 from Du Pont-Mitsui Fluorochemicals Co., Ltd) | 10 |
| Surfactant (BYK-P105 from BYK-Chemie GmbH) | 2.7 |
| Tetrahydrofuran | 821 |
| Cyclohexanone | 205 |

Example 33

The procedure for preparation of the electrophotographic photoreceptor in Example 31 was repeated to prepare an electrophotographic photoreceptor except for replacing 100 parts of bisphenol Z polycarbonate in the surface layer coating liquid with 100 parts of trimethylolpropanetriacrylate (TMPTA from Tokyo Chemical Industry Co., Ltd.) and 5 parts of a photopolymerization initiator (1-hydroxy-cyclohexyl-phenyl-ketone, IRGACURE 184 from Ciba Specialty Chemicals) to prepare a surface layer coating liquid, coating the surface layer coating liquid on the layered body, irradiating the surface layer coating liquid with light from a metal halide lamp at an illuminance of 900 $mW/cm^2$ for 120 sec to be crosslinked while rotating the layered body to form a surface layer, and drying the surface layer at 130° C. for 30 min.

Comparative Example 1

The procedure for preparation of the electrophotographic photoreceptor in Example was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Tetrahydrofuran | 533 |
| Cyclohexanone | 133 |

Comparative Example 2

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Charge transportable compound having the following formula (2): | 10 |

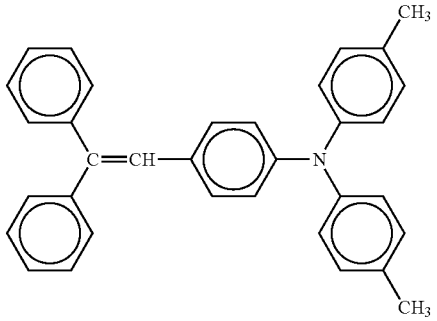

(2)

| | |
|---|---|
| Tetrahydrofuran | 587 |
| Cyclohexanone | 147 |

Comparative Example 3

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate<br>(Panlite TS-2050 from TEIJIN CHEMICALS LTD.) | 100 |
| Charge transportable compound<br>having the following formula (2): | 20 |

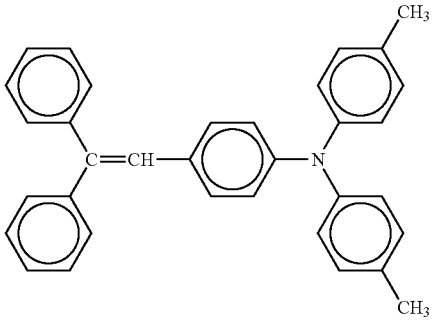

(2)

-continued

| | |
|---|---|
| Tetrahydrofuran | 640 |
| Cyclohexanone | 160 |

Comparative Example 4

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate<br>(TMPTA from Tokyo Chemical Industry Co., Ltd.) | 100 |
| Photopolymerization initiator<br>(1-hydroxy-cyclohexyl-phenyl-ketone)<br>(IRGACURE 184 from Ciba Specialty Chemicals) | 5 |
| Terrahydrofuran | 533 |
| Cyclohexanone | 133 |

Comparative Example 5

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate<br>(TMPTA from Tokyo Chemical Industry Co., Ltd.) | 100 |
| Photopolymerization initiator<br>(1-hydroxy-cyclohexyl-phenyl-ketone)<br>(IRGACURE 184 from Ciba Specialty Chemicals) | 5 |
| Charge transportable compound<br>having the following formula (3): | 10 |

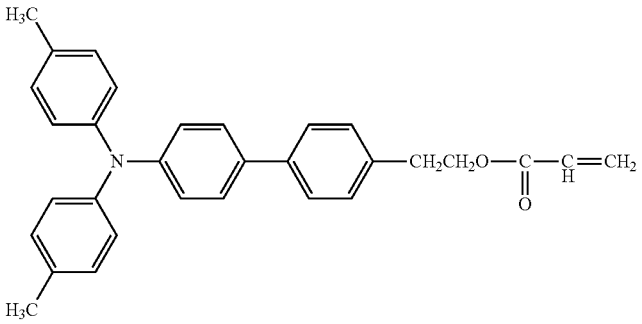

(3)

| | |
|---|---|
| Tetrahydrofuran | 587 |
| Cyclohexanone | 147 |

Comparative Example 6

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate (TMPTA from Tokyo Chemical Industry Co., Ltd.) | 100 |
| Photopolymerization initiator (1-hydroxy-cyclohexyl-phenyl-ketone) (IRGACURE 184 from Ciba Specialty Chemicals) | 5 |
| Charge transportable compound having the following formula (3): | 20 |

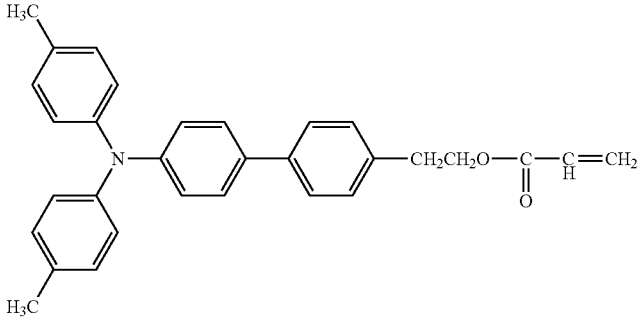

(3)

| | |
|---|---|
| Tetrahydrofuran | 640 |
| Cyclohexanone | 160 |

Comparative Example 7

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with gallium (Pazet GK-40 having an average particle diameter of 32 nm from Hakusuitech, Ltd.) | 5.3 |
| Surfactant (BYK-P105 from BYK-Chemie GmbH) | 2.7 |
| Tetrahydrofuran | 561 |
| Cyclohexanone | 140 |

Comparative Example 8

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with gallium (Pazet GK-40 having an average particle diameter of 32 nm from Hakusuitech, Ltd.) | 11.1 |
| Surfactant (BYK-P105 from BYK-Chemie GmbH) | 0.6 |
| Tetrahydrofuran | 593 |
| Cyclohexanone | 148 |

Comparative Example 9

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| Zinc oxide doped with gallium (Pazet GK-40 having an average particle diameter of 32 nm from Hakusuitech, Ltd.) | 233.3 |
| Surfactant (BYK-P105 from BYK-Chemie GmbH) | 11.7 |
| Tetrahydrofuran | 1,779 |
| Cyclohexanone | 444 |

Comparative Example 10

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate (TMPTA from Tokyo Chemical Industry Co., Ltd.) | 100 |
| Photopolymerization initiator (1-hydroxy-cyclohexyl-phenyl-ketone) (IRGACURE 184 from Ciba Specialty Chemicals) | 5 |
| Zinc oxide doped with gallium (Pazet GK-40 having an average particle diameter of 32 nm from Hakusuitech, Ltd.) | 5.3 |
| Surfactant (BYK-P105 from BYK-Chemie GmbH) | 0.3 |
| Tetrahydrofuran | 561 |
| Cyclohexanone | 140 |

Comparative Example 11

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate (TMPTA from Tokyo Chemical Industry Co., Ltd.) | 100 |
| Photopolymerization initiator (1-hydroxy-cyclohexyl-phenyl-ketone) (IRGACURE 184 from Ciba Specialty Chemicals) | 5 |
| Zinc oxide doped with gallium (Pazet GK-40 having an average particle diameter of 32 nm from Hakusuitech, Ltd.) | 11.1 |
| Surfactant (BYK-P105 from BYK-Chemie GmbH) | 0.6 |
| Tetrahydrofuran | 593 |
| Cyclohexanone | 148 |

Comparative Example 12

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate (TMPTA from Tokyo Chemical Industry Co., Ltd.) | 100 |
| Photopolymerization initiator (1-hydroxy-cyclohexyl-phenyl-ketone) (IRGACURE 184 from Ciba Specialty Chemicals) | 5 |
| Zinc oxide doped with gallium (Pazet GK-40 having an average particle diameter of 32 nm from Hakusuitech, Ltd.) | 233.3. |
| Surfactant (BYK-P105 from BYK-Chemie GmbH) | 11.7 |
| Tetrahydrofuran | 1,779 |
| Cyclohexanone | 444 |

Comparative Example 13

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| charge transportable compound having the following formula (2): | 30 |

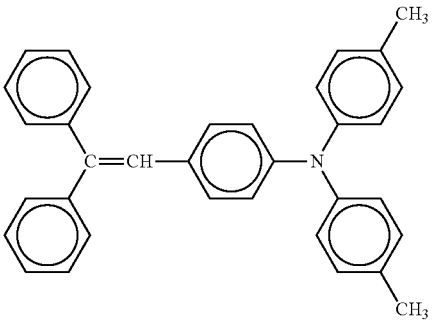

(2)

-continued

| | |
|---|---|
| Zinc oxide doped with gallium (Pazet GK-40 having an average particle diameter of 32 nm from Hakusuitech, Ltd.) | 130 |
| Photopolymerization initiator (1-hydroxy-cyclohexyl-phenyl-ketone) (IRGACURE 184 from Ciba Specialty Chemicals) | 5 |
| Surfactant (BYK-P105 from BYK-Chemie GmbH) | 6.5 |
| Tetrahydrofuran | 1,387 |
| Cyclohexanone | 347 |

Comparative Example 14

The procedure for preparation of the electrophotographic photoreceptor in Example 1 was repeated to prepare an electrophotographic photoreceptor except for replacing the surface layer coating liquid with a surface layer coating liquid having the following composition.

[Surface Layer Coating Liquid]

| | |
|---|---|
| Bisphenol Z polycarbonate (Panlite TS-2050 from TEIJIN CHEMICALS LTD.) | 100 |
| charge transportable compound having the following formula (2): | 40 |

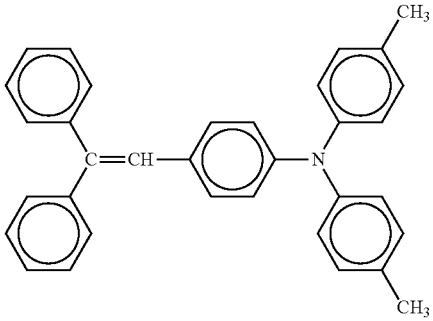

(2)

| | |
|---|---|
| Zinc oxide doped with gallium (Pazet GK-40 having an average particle diameter of 32 nm from Hakusuitech, Ltd.) | 140 |
| Photopolymerization initiator (1-hydroxy-cyclohexyl-phenyl-ketone) (IRGACURE 184 from Ciba Specialty Chemicals) | 5 |
| Surfactant (BYK-P105 from BYK-Chemie GmbH) | 7.0 |
| Tetrahydrofuran | 1,493 |
| Cyclohexanone | 373 |

Comparative Example 15

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate<br>(TMPTA from Tokyo Chemical Industry Co., Ltd.) | 100 |
| Charge transportable compound<br>having the following formula (3): | 30 |

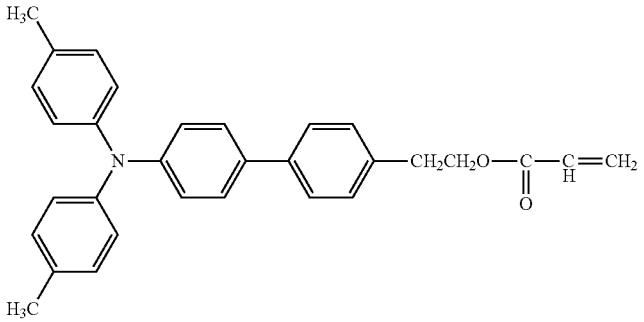

(3)

| | |
|---|---|
| Photopolymerization initiator<br>(1-hydroxy-cyclohexyl-phenyl-ketone)<br>(IRGACURE 184 from Ciba Specialty Chemicals) | 5 |
| Zinc oxide doped with gallium<br>(Pazet GK-40 having an average particle diameter of 32 nm from Hakusuitech, Ltd.) | 130 |
| Surfactant<br>(BYK-P105 from BYK-Chemie GmbH) | 6.5 |
| Tetrahydrofuran | 1,387 |
| Cyclohexanone | 347 |

Comparative Example 16

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate<br>(TMPTA from Tokyo Chemical Industry Co., Ltd.) | 100 |
| Charge transportable compound<br>having the following formula (3): | 40 |

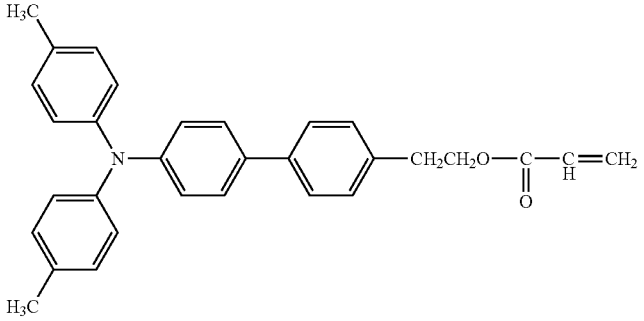

(3)

| | |
|---|---|
| Photopolymerization initiator<br>(1-hydroxy-cyclohexyl-phenyl-ketone)<br>(IRGACURE 184 from Ciba Specialty Chemicals) | 5 |
| Zinc oxide doped with gallium<br>(Pazet GK-40 having an average particle diameter of 32 nm from Hakusuitech, Ltd.) | 140 |
| Surfactant<br>(BYK-P105 from BYK-Chemie GmbH) | 7.0 |
| Tetrahydrofuran | 1,493 |
| Cyclohexanone | 373 |

Comparative Example 17

The procedure for preparation of the electrophotographic photoreceptor in Example 1 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 18

The procedure for preparation of the electrophotographic photoreceptor in Example 2 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 19

The procedure for preparation of the electrophotographic photoreceptor in Example 3 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 20

The procedure for preparation of the electrophotographic photoreceptor in Example 4 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 21

The procedure for preparation of the electrophotographic photoreceptor in Example 11 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 22

The procedure for preparation of the electrophotographic photoreceptor in Example 12 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 23

The procedure for preparation of the electrophotographic photoreceptor in Example 13 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 24

The procedure for preparation of the electrophotographic photoreceptor in Example 14 was repeated to prepare an electrophotographic photoreceptor except for replacing zinc oxide doped with aluminum in the surface layer coating liquid with zinc oxide Nanotek ZnO having an average particle diameter of 34 nm from C. I. KASEI CO., LTD.

Comparative Example 25

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate (TMPTA from Tokyo Chemical Industry Co., Ltd.) | 100 |
| Photopolymerization initiator (1-hydroxy-cyclohexyl-phenyl-ketone) (IRGACURE 184 from Ciba Specialty Chemicals) | 5 |
| Particulate titanium oxide (Nanotek $TiO_2$ having an average particle diameter of 36 nm from C.I. KASEI CO., LTD. | 53.8 |
| Surfactant (BYK-P105 from BYK-Chemie GmbH) | 2.7 |
| Tetrahydrofuran | 821 |
| Cyclohexanone | 205 |

Comparative Example 26

The procedure for preparation of the electrophotographic photoreceptor in Example 11 was repeated to prepare an electrophotographic photoreceptor except for replacing the surface layer coating liquid with a surface layer coating liquid having the following composition.

| | |
|---|---|
| Trimethylolpropanetriacrylate (TMPTA from Tokyo Chemical Industry Co., Ltd.) | 100 |
| Photopolymerization initiator (1-hydroxy-cyclohexyl-phenyl-ketone) (IRGACURE 184 from Ciba Specialty Chemicals) | 5 |
| Particulate titanium oxide (Nanotek $TiO_2$ having an average particle diameter of 36 nm from C.I. KASEI CO., LTD. | 100 |
| Surfactant (BYK-P105 from BYK-Chemie GmbH) | 5.0 |
| Tetrahydrofuran | 1,067 |
| Cyclohexanone | 267 |

Comparative Example 27

The procedure for preparation of the electrophotographic photoreceptor in Example 25 was repeated to prepare an electrophotographic photoreceptor except for replacing particulate titanium oxide in the surface layer coating liquid with particulate aluminum oxide Nanotek $Al_2O_3$ having an average particle diameter of 31 nm from C. I. KASEI CO., LTD.

Comparative Example 28

The procedure for preparation of the electrophotographic photoreceptor in Example 26 was repeated to prepare an electrophotographic photoreceptor except for replacing particulate titanium oxide in the surface layer coating liquid with particulate aluminum oxide Nanotek $Al_2O_3$ having an average particle diameter of 31 nm from C. I. KASEI CO., LTD.

Comparative Example 29

The procedure for preparation of the electrophotographic photoreceptor in Example 25 was repeated to prepare an electrophotographic photoreceptor except for replacing particulate titanium oxide in the surface layer coating liquid with particulate tin oxide Nanotek $SnO_2$ having an average particle diameter of 21 nm from C. I. KASEI CO., LTD.

Comparative Example 30

The procedure for preparation of the electrophotographic photoreceptor in Example 26 was repeated to prepare an electrophotographic photoreceptor except for replacing particulate titanium oxide in the surface layer coating liquid with particulate tin oxide Nanotek $SnO_2$ having an average particle diameter of 21 nm from C. I. KASEI CO., LTD.

The electrophotographic photoreceptors prepared in Examples 1 to 29 and 31 to 33 and Comparative Examples 1 to 30 are shown in Table 1.

TABLE 1

| | Surface Layer Materials | | | | | |
|---|---|---|---|---|---|---|
| | Essential Component | | | | Other Component | |
| | | Zinc Oxide Doped with boron group | | | Surfactant | |
| | Resin having no charge transportability | | % by volume | Average primary particle diameter (nm) | [(+) = particulate fluorine-containing resin)] | Charge transportable Compound |
| Example 1 | Polycarbonate | Al—Zn—O | 8.8 | 34 | BYK-P105 | — |
| Example 2 | Polycarbonate | Al—Zn—O | 16.2 | 34 | BYK-P105 | — |
| Example 3 | Polycarbonate | Al—Zn—O | 22.5 | 34 | BYK-P105 | — |
| Example 4 | Polycarbonate | Al—Zn—O | 30.4 | 34 | BYK-P105 | — |
| Example 5 | Polycarbonate | Ga—Zn—O | 8.8 | 30 | BYK-P105 | — |
| Example 6 | Polycarbonate | Ga—Zn—O | 16.2 | 30 | BYK-P105 | — |
| Example 7 | Polycarbonate | Ga—Zn—O | 22.5 | 30 | BYK-P105 | — |
| Example 8 | Polycarbonate | Ga—Zn—O | 30.4 | 30 | BYK-P105 | — |
| Example 9 | Polycarbonate | Ga—Zn—O | 24.2 | 30 | BYK-P105 | (2) 10 parts |
| Example 10 | Polycarbonate | Ga—Zn—O | 25.9 | 30 | BYK-P105 | (2) 20 parts |
| Example 11 | Acrylic | Al—Zn—O | 8.8 | 30 | BYK-P105 | — |
| Example 12 | Acrylic | Al—Zn—O | 16.2 | 30 | BYK-P105 | — |
| Example 13 | Acrylic | Al—Zn—O | 22.5 | 30 | BYK-P105 | — |
| Example 14 | Acrylic | Al—Zn—O | 30.4 | 30 | BYK-P105 | — |
| Example 15 | Acrylic | Ga—Zn—O | 8.8 | 30 | BYK-P105 | — |
| Example 16 | Acrylic | Ga—Zn—O | 16.2 | 30 | BYK-P105 | — |
| Example 17 | Acrylic | Ga—Zn—O | 22.5 | 30 | BYK-P105 | — |
| Example 18 | Acrylic | Ga—Zn—O | 30.4 | 30 | BYK-P105 | — |
| Example 19 | Acrylic | Ga—Zn—O | 24.2 | 30 | BYK-P105 | (3) 10 parts |
| Example 20 | Acrylic | Ga—Zn—O | 25.9 | 30 | BYK-P105 | (3) 20 parts |
| Example 21 | Acrylic | Al—Zn—O | 22.5 | 150 | BYK-P105 | — |
| Example 22 | Acrylic | Al—Zn—O | 22.5 | 150 | BYK-P105 | — |
| Example 23 | Acrylic | Ga—Zn—O | 22.5 | 30 | BYK-P105 | — |
| Example 24 | Acrylic | Ga—Zn—O | 22.5 | 30 | BYK-P105 | — |
| Example 25 | Polyarylate | Ga—Zn—O | 22.5 | 30 | BYK-P105 | — |
| Example 26 | Styrene | Ga—Zn—O | 22.5 | 30 | BYK-P105 | — |
| Example 27 | Phenol | Ga—Zn—O | 22.5 | 30 | BYK-P105 | — |
| Example 28 | Urethane | Ga—Zn—O | 22.5 | 30 | BYK-P105 | — |
| Example 29 | Silicone | Ga—Zn—O | 22.5 | 30 | BYK-P105 | — |
| Example 31 | Polycarbonate | Al—Zn—O | 13.2 | 34 | BYK-P105 (+) | — |
| Example 32 | Polycarbonate | Ga—Zn—O | 13.2 | 30 | BYK-P105 (+) | — |
| Example 33 | Acrylic | Al—Zn—O | 13.2 | 30 | BYK-P105 (+) | — |
| Comparative Example 1 | Polycarbonate | — | — | — | — | — |
| Comparative Example 2 | Polycarbonate | — | — | — | — | (2) 10 parts |
| Comparative Example 3 | Polycarbonate | — | — | — | — | (2) 20 parts |
| Comparative Example 4 | Acrylic | — | — | — | — | — |
| Comparative Example 5 | Acrylic | — | — | — | — | (3) 10 parts |
| Comparative Example 6 | Acrylic | — | — | — | — | (3) 20 parts |
| Comparative Example 7 | Polycarbonate | Ga—Zn—O | 1.5 | 30 | BYK-P105 | — |
| Comparative Example 8 | Polycarbonate | Ga—Zn—O | 3.1 | 30 | BYK-P105 | — |
| Comparative Example 9 | Polycarbonate | Ga—Zn—O | 40.4 | 30 | BYK-P105 | — |
| Comparative Example 10 | Acrylic | Ga—Zn—O | 1.5 | 30 | BYK-P105 | — |
| Comparative Example 11 | Acrylic | Ga—Zn—O | 3.1 | 30 | BYK-P105 | — |
| Comparative Example 12 | Acrylic | Ga—Zn—O | 40.4 | 30 | BYK-P105 | — |
| Comparative Example 13 | Polycarbonate | Ga—Zn—O | 27.4 | 30 | BYK-P105 | (2) 10 parts |
| Comparative Example 14 | Polycarbonate | Ga—Zn—O | 27.4 | 30 | BYK-P105 | (2) 20 parts |

TABLE 1-continued

| | Surface Layer Materials | | | | | |
|---|---|---|---|---|---|---|
| | Essential Component | | | | Other Component | |
| | | Zinc Oxide Doped with boron group | | | Surfactant | |
| | Resin having no charge transportability | | % by volume | Average primary particle diameter (nm) | [(+) = particulate fluorine-containing resin)] | Charge transportable Compound |
| Comparative Example 15 | Acrylic | Ga—Zn—O | 27.4 | 30 | BYK-P105 | (3) 10 parts |
| Comparative Example 16 | Acrylic | Ga—Zn—O | 27.4 | 30 | BYK-P105 | (3) 20 parts |
| Comparative Example 17 | Polycarbonate | ZnO | 8.8 | 34 | BYK-P105 | — |
| Comparative Example 18 | Polycarbonate | ZnO | 16.2 | 34 | BYK-P105 | — |
| Comparative Example 19 | Polycarbonate | ZnO | 22.5 | 34 | BYK-P105 | — |
| Comparative Example 20 | Polycarbonate | ZnO | 30.4 | 34 | BYK-P105 | — |
| Comparative Example 21 | Acrylic | ZnO | 8.8 | 34 | BYK-P105 | — |
| Comparative Example 22 | Acrylic | ZnO | 16.2 | 34 | BYK-P105 | — |
| Comparative Example 23 | Acrylic | ZnO | 22.5 | 34 | BYK-P105 | — |
| Comparative Example 24 | Acrylic | ZnO | 30.4 | 34 | BYK-P105 | — |
| Comparative Example 25 | Acrylic | $TiO_2$ | 17.0 | 36 | BYK-P105 | — |
| Comparative Example 26 | Acrylic | $TiO_2$ | 27.6 | 36 | BYK-P105 | — |
| Comparative Example 27 | Acrylic | $Al_2O_3$ | 18.1 | 31 | BYK-P105 | — |
| Comparative Example 28 | Acrylic | $Al_2O_3$ | 29.1 | 31 | BYK-P105 | — |
| Comparative Example 29 | Acrylic | $SnO_2$ | 11.0 | 21 | BYK-P105 | — |
| Comparative Example 30 | Acrylic | $SnO_2$ | 18.6 | 21 | BYK-P105 | — |

The surface specific resistivity R1 when the surface layer has an electric field intensity of $1\times10^4$ V/cm was measured. Electrodes having a length of 10 mm and a gap of 25 μm were formed on the electrophotographic photoreceptor, and a suitable bias calculated from the gap was applied thereto to set the electric field intensity at $1\times10^4$ V/cm. R1 was defined as an average of values measured at three positions 70, 170 and 270 mm from an upper end of the surface layer of the electrophotographic photoreceptor.

The surface specific resistivity R3 when the surface layer has an electric field intensity of $3\times10^4$ V/cm was measured. Electrodes having a length of 10 mm and a gap of 25 μm were formed on the electrophotographic photoreceptor, and a suitable bias calculated from the gap was applied thereto to set the electric field intensity at $1\times10^4$ V/cm. R3 was defined as an average of values measured at three positions 70, 170 and 270 mm from an upper end of the surface layer of the electrophotographic photoreceptor.

The surface specific resistivity R15 when the surface layer has an electric field intensity of $1.5\times10^5$ V/cm was measured. Electrodes having a length of 10 mm and a gap of 25 μm were formed on the electrophotographic photoreceptor, and a suitable bias calculated from the gap was applied thereto to set the electric field intensity at $1.5\times10^5$ V/cm. R15 was defined as an average of values measured at three positions 70, 170 and 270 mm from an upper end of the surface layer of the electrophotographic photoreceptor.

The surface resistivities were measured under the following conditions. The results are shown in Table 2

Current-voltage meter: Source Measure Unit Type 2410 from Keithley Instruments, Inc.

Electrode metal: gold

Electrode length: 10 mm

Electrode gap: 25 μm

Atmosphere: 25° C./50% RH

Time: 70 sec (surface resistivity was calculated from a current 60 sec after a voltage was applied)

TABLE 2

| | Surface Layer Properties | | | | |
|---|---|---|---|---|---|
| | Surface Resistivity (Ω/cm²) | | | R1/ | R1/ |
| | R1 | R3 | R15 | R3 | R15 |
| Example 1 | $1.54\times10^{14}$ | $1.15\times10^{14}$ | $1.99\times10^{11}$ | 1.3 | 772 |
| Example 2 | $9.11\times10^{13}$ | $7.59\times10^{13}$ | $6.73\times10^{10}$ | 1.2 | 1354 |
| Example 3 | $6.59\times10^{13}$ | $2.64\times10^{13}$ | $2.62\times10^{10}$ | 2.5 | 2518 |
| Example 4 | $4.46\times10^{13}$ | $7.82\times10^{12}$ | $1.13\times10^{10}$ | 5.7 | 3940 |
| Example 5 | $5.20\times10^{14}$ | $4.20\times10^{14}$ | $8.46\times10^{11}$ | 1.2 | 614 |
| Example 6 | $2.10\times10^{14}$ | $1.94\times10^{14}$ | $1.51\times10^{11}$ | 1.1 | 1390 |
| Example 7 | $1.90\times10^{14}$ | $1.03\times10^{14}$ | $7.54\times10^{10}$ | 1.8 | 519 |
| Example 8 | $1.01\times10^{14}$ | $4.28\times10^{13}$ | $2.78\times10^{10}$ | 2.4 | 3633 |
| Example 9 | $4.95\times10^{13}$ | $2.85\times10^{13}$ | $2.25\times10^{10}$ | 1.7 | 2200 |
| Example 10 | $2.18\times10^{13}$ | $1.18\times10^{13}$ | $1.01\times10^{10}$ | 1.8 | 2158 |
| Example 11 | $3.18\times10^{14}$ | $2.97\times10^{14}$ | $5.44\times10^{11}$ | 1.1 | 585 |

TABLE 2-continued

| | Surface Layer Properties | | | | |
|---|---|---|---|---|---|
| | Surface Resistivity ($\Omega/cm^2$) | | | R1/ | R1/ |
| | R1 | R3 | R15 | R3 | R15 |
| Example 12 | $1.52 \times 10^{14}$ | $1.50 \times 10^{14}$ | $1.32 \times 10^{11}$ | 1.5 | 1154 |
| Example 13 | $8.77 \times 10^{13}$ | $3.05 \times 10^{13}$ | $3.99 \times 10^{10}$ | 2.9 | 2198 |
| Example 14 | $5.69 \times 10^{13}$ | $1.35 \times 10^{13}$ | $1.70 \times 10^{10}$ | 4.2 | 335 |
| Example 15 | $4.38 \times 10^{14}$ | $3.88 \times 10^{14}$ | $8.61 \times 10^{11}$ | 1.1 | 509 |
| Example 16 | $1.96 \times 10^{14}$ | $1.65 \times 10^{14}$ | $1.70 \times 10^{11}$ | 1.2 | 1153 |
| Example 17 | $1.33 \times 10^{14}$ | $7.64 \times 10^{13}$ | $6.02 \times 10^{10}$ | 1.7 | 2210 |
| Example 18 | $9.87 \times 10^{13}$ | $3.87 \times 10^{13}$ | $2.60 \times 10^{10}$ | 2.6 | 3801 |
| Example 19 | $5.11 \times 10^{13}$ | $3.38 \times 10^{13}$ | $2.68 \times 10^{10}$ | 1.5 | 1906 |
| Example 20 | $2.89 \times 10^{13}$ | $1.54 \times 10^{13}$ | $1.44 \times 10^{10}$ | 1.9 | 2014 |
| Example 21 | $7.88 \times 10^{14}$ | $5.40 \times 10^{14}$ | $9.82 \times 10^{11}$ | 1.5 | 803 |
| Example 22 | $9.15 \times 10^{14}$ | $4.36 \times 10^{14}$ | $6.14 \times 10^{11}$ | 2.1 | 1490 |
| Example 23 | $8.23 \times 10^{14}$ | $3.43 \times 10^{14}$ | $3.92 \times 10^{11}$ | 2.4 | 2101 |
| Example 24 | $7.73 \times 10^{14}$ | $2.42 \times 10^{14}$ | $3.99 \times 10^{11}$ | 3.2 | 1905 |
| Example 25 | $2.11 \times 10^{14}$ | $1.9 \times 10^{14}$ | $8.68 \times 10^{10}$ | 1.8 | 2432 |
| Example 26 | $2.27 \times 10^{14}$ | $1.24 \times 10^{14}$ | $8.06 \times 10^{10}$ | 1.8 | 2816 |
| Example 27 | $1.84 \times 10^{14}$ | $1.09 \times 10^{14}$ | $7.18 \times 10^{10}$ | 1.7 | 2564 |
| Example 28 | $4.84 \times 10^{14}$ | $2.83 \times 10^{14}$ | $1.97 \times 10^{11}$ | 1.7 | 2461 |
| Example 29 | $5.98 \times 10^{13}$ | $3.23 \times 10^{13}$ | $2.34 \times 10^{10}$ | 1.9 | 2554 |
| Example 31 | $9.85 \times 10^{13}$ | $8.96 \times 10^{13}$ | $6.85 \times 10^{10}$ | 1.1 | 1438 |
| Example 32 | $4.21 \times 10^{13}$ | $2.45 \times 10^{13}$ | $1.80 \times 10^{11}$ | 1.7 | 2339 |
| Example 33 | $1.62 \times 10^{14}$ | $1.70 \times 10^{14}$ | $1.28 \times 10^{11}$ | 1.1 | 1266 |
| Comparative Example 1 | $7.54 \times 10^{15}$ | $1.01 \times 10^{16}$ | $7.25 \times 10^{15}$ | 0.8 | 1 |
| Comparative Example 2 | $6.59 \times 10^{14}$ | $5.94 \times 10^{14}$ | $3.21 \times 10^{13}$ | 1.1 | 21 |
| Comparative Example 3 | $1.48 \times 10^{14}$ | $1.37 \times 10^{14}$ | $2.80 \times 10^{12}$ | 1.1 | 53 |
| Comparative Example 4 | $5.49 \times 10^{15}$ | $6.78 \times 10^{15}$ | $5.44 \times 10^{15}$ | 0.8 | 1 |
| Comparative Example 5 | $3.88 \times 10^{14}$ | $3.70 \times 10^{14}$ | $2.46 \times 10^{13}$ | 1.1 | 16 |
| Comparative Example 6 | $7.54 \times 10^{14}$ | $6.28 \times 10^{14}$ | $1.59 \times 10^{13}$ | 1.2 | 48 |
| Comparative Example 7 | $1.85 \times 10^{15}$ | $1.89 \times 10^{15}$ | $1.68 \times 10^{13}$ | 1 | 11 |
| Comparative Example 8 | $9.14 \times 10^{14}$ | $8.70 \times 10^{14}$ | $1.42 \times 10^{13}$ | 1.1 | 64 |
| Comparative Example 9 | $3.95 \times 10^{12}$ | $2.21 \times 10^{11}$ | $6.42 \times 10^{8}$ | 17.9 | 6155 |
| Comparative Example 10 | $2.95 \times 10^{15}$ | $2.98 \times 10^{15}$ | $1.97 \times 10^{14}$ | 1 | 15 |
| Comparative Example 11 | $1.26 \times 10^{15}$ | $1.27 \times 10^{15}$ | $1.69 \times 10^{13}$ | 1 | 75 |
| Comparative Example 12 | $4.88 \times 10^{12}$ | $3.21 \times 10^{11}$ | $7.03 \times 10^{8}$ | 15.2 | 6945 |
| Comparative Example 13 | $8.52 \times 10^{12}$ | $6.50 \times 10^{12}$ | $1.09 \times 10^{11}$ | 1.3 | 75 |
| Comparative Example 14 | $7.19 \times 10^{11}$ | $4.92 \times 10^{11}$ | $7.90 \times 10^{9}$ | 1.5 | 91 |
| Comparative Example 15 | $7.33 \times 10^{12}$ | $5.73 \times 10^{12}$ | $1.14 \times 10^{11}$ | 1.3 | 64 |
| Comparative Example 16 | $5.85 \times 10^{11}$ | $4.03 \times 10^{11}$ | $6.59 \times 10^{9}$ | 1.5 | 89 |
| Comparative Example 17 | $1.02 \times 10^{14}$ | $7.61 \times 10^{13}$ | $1.10 \times 10^{11}$ | 1.3 | 928 |
| Comparative Example 18 | $7.43 \times 10^{13}$ | $4.40 \times 10^{13}$ | $4.01 \times 10^{10}$ | 1.7 | 1852 |
| Comparative Example 19 | $4.51 \times 10^{13}$ | $7.22 \times 10^{12}$ | $1.50 \times 10^{10}$ | 6.3 | 3000 |
| Comparative Example 20 | $2.88 \times 10^{13}$ | $1.82 \times 10^{12}$ | $6.23 \times 10^{9}$ | 15.8 | 4620 |
| Comparative Example 21 | $8.75 \times 10^{13}$ | $7.61 \times 10^{13}$ | $1.03 \times 10^{11}$ | 1.2 | 851 |
| Comparative Example 22 | $5.27 \times 10^{13}$ | $3.42 \times 10^{13}$ | $3.18 \times 10^{10}$ | 1.5 | 1658 |
| Comparative Example 23 | $3.48 \times 10^{13}$ | $7.60 \times 10^{12}$ | $1.19 \times 10^{10}$ | 4.6 | 2915 |
| Comparative Example 24 | $1.55 \times 10^{13}$ | $1.10 \times 10^{12}$ | $3.64 \times 10^{9}$ | 14.1 | 4257 |
| Comparative Example 25 | $7.88 \times 10^{13}$ | $5.97 \times 10^{13}$ | $4.91 \times 10^{10}$ | 1.3 | 1606 |

TABLE 2-continued

| | Surface Layer Properties | | | | |
|---|---|---|---|---|---|
| | Surface Resistivity ($\Omega/cm^2$) | | | R1/ | R1/ |
| | R1 | R3 | R15 | R3 | R15 |
| Comparative Example 26 | $3.51 \times 10^{13}$ | $1.66 \times 10^{13}$ | $1.13 \times 10^{10}$ | 2.1 | 3112 |
| Comparative Example 27 | $8.47 \times 10^{14}$ | $7.56 \times 10^{14}$ | $6.32 \times 10^{11}$ | 1.1 | 1340 |
| Comparative Example 28 | $3.19 \times 10^{14}$ | $1.82 \times 10^{14}$ | $1.23 \times 10^{11}$ | 1.8 | 2604 |
| Comparative Example 29 | $5.52 \times 10^{14}$ | $3.81 \times 10^{14}$ | $3.61 \times 10^{11}$ | 1.5 | 1529 |
| Comparative Example 30 | $1.59 \times 10^{14}$ | $6.68 \times 10^{13}$ | $5.49 \times 10^{10}$ | 2.4 | 2894 |

The electrophotographic photoreceptors in Examples 1 to 29 have a high surface resistivity not less than $10^{13}$ $\Omega/cm^2$ in a low electric field ($1\times10^4$ V/cm). In addition, R1/R3 is 10 or less, and the surface resistivity is quite stable in a low electric field.

Meanwhile, the electrophotographic photoreceptors in Comparative Examples 1 to 8, and 11 have a high surface resistivity ($10^{13}$ $\Omega/cm^2$) in a low electric field ($1\times10^4$ V/cm), but the electrophotographic photoreceptors in Comparative Examples 9 and 12 to 16 have a low surface resistivity in a low electric field. It is thought that this is due to the contents of the inorganic particulate material and the charge transportable compound. However, R1/R3 thereof is as low as those of Examples except for Comparative Examples 9, 12, 20 and 24, and has stable surface resistivity in a low electric field. R1/R3 of the electrophotographic photoreceptors in Comparative Examples 9, 12, 20 and 24 is over 10 and the surface resistivity is unstable in a low electric field.

The electrophotographic photoreceptors in Comparative Examples 17 to 30 which do not include zinc oxide doped with a boron group have a high surface resistivity not less than $10^{13}$ $\Omega/cm^2$ in a low electric field ($1\times10^4$ V/cm) and R1/R3 thereof are as low as those of Examples.

The electrophotographic photoreceptors in Examples 1 to 29 have lower surface resistivities in a high electric field than in a low electric field by 2 to 4 digits. Particularly when the content of the inorganic particulate material is large, a ratio (R1/R15) of the surface resistivity in a low electric field to that in a high electric field is large about 4,000. This is same when the surface layer includes a small amount of the charge transportable compound (20 parts by weight or less per 100 parts of the resin having no charge transportability). It is thought that the content of the charge transportable compound of the present invention decreases an influence to the surface resistivity and increases charge transportability.

The electrophotographic photoreceptors in Comparative Examples 1 to 6 which do not include an inorganic particulate material have smaller R1/R15 than the electrophotographic photoreceptors in Examples, and do not have larger R1/R15 even when including the charge transportable compound.

The electrophotographic photoreceptors in Comparative Examples 7, 8, 10 and 11 including less inorganic particulate material do not have large R1/R15 even in a high electric field. It is thought they have poor charge transportability in a high electric field.

The electrophotographic photoreceptors in Comparative Examples 9 and 12 including much inorganic particulate material have large R1/R15 as much as 5,000 or more. This is because the inorganic particulate materials contact each other to increase electroconductive pass and film resistance is small in a high electric field.

The electrophotographic photoreceptors in Comparative Examples 13 and 16 include both of the inorganic particulate material and a large amount of the charge transportable compound. The surface resistivity in a low electric field and that in a high electric field are low, but R1/R15 is not large.

Members except for charging units such as cleaning units were removed from an image forming apparatus Imagio MP C5000 from Ricoh Company, Ltd. to perform running tests. The electrophotographic photoreceptors prepared in Examples 1 to 29 and 31 to 33 and Comparative Examples 1 to 30 were installed in the modified image forming apparatus Imagio MP C5000 so that only charging and developing could be repeated without printing out.

Charging Conditions

Charging member: charging roller

Voltage: DC voltage overlapped with AC voltage

Peak-to-peak voltage Vpp of AC voltage: 1.9 kV

Frequency: 900 Hz

DC voltage: −650 V

Rotational speed of electrophotographic photoreceptor: 230 mm/sec

Developing Conditions

Irradiation: LD having a wavelength of 655 nm

Writing Pattern: 100%

A passing charge amount calculation proves that running for about 2.5 hrs is necessary for the electrophotographic photoreceptor to have an electrostatic fatigue equal to 100,000 running (5% test pattern/charge-irradiation potential difference 550 V/photoreceptor electrostaticity capacity 110 pF/cm$^2$), the electrostatic fatigue test equal to 100,000 running was performed.

In image production evaluation, IPSiO MP C5000 from Ricoh Company, Ltd., which was modified not to have an initial idling process when producing images was used. In electrical properties and image production evaluations, a toner Imagio toner type 27 from Ricoh Company, Ltd. and NBS My Paper (A4 size from Ricoh Company, Ltd.) were used.

—Evaluation of Electrical Properties—

Initial photoreceptor surface potential was −650 V, and the potentials before and after the electrostatic fatigue test were measured. The results are shown in Table 3-1.

—Evaluation of Image Production—

Thirty thousand (30,000) halftone images were continuously produced, and dot reproducibility before and after production were observed visually and with a microscope. The results are shown in Table 3-2

TABLE 3-1

| | Electrical Properties | | | | | |
|---|---|---|---|---|---|---|
| | Dark Space Potential | | | Bright Space Potential | | |
| | Before | After | Difference | Before | After | Difference |
| Example 1 | 650 | 650 | 0 | 90 | 125 | 35 |
| Example 2 | 645 | 645 | 0 | 80 | 115 | 35 |
| Example 3 | 645 | 640 | 5 | 75 | 105 | 30 |
| Example 4 | 650 | 655 | −5 | 70 | 95 | 25 |
| Example 5 | 650 | 655 | −5 | 75 | 80 | 5 |
| Example 6 | 645 | 645 | 0 | 75 | 80 | 5 |
| Example 7 | 655 | 650 | 5 | 70 | 70 | 0 |
| Example 8 | 640 | 640 | 0 | 65 | 65 | 0 |
| Example 9 | 645 | 640 | 5 | 90 | 95 | 5 |
| Example 10 | 645 | 650 | −5 | 85 | 85 | 0 |
| Example 11 | 655 | 655 | 0 | 80 | 105 | 25 |
| Example 12 | 660 | 655 | 5 | 75 | 100 | 25 |
| Example 13 | 650 | 650 | 0 | 70 | 90 | 20 |
| Example 14 | 650 | 655 | −5 | 70 | 90 | 20 |

TABLE 3-1-continued

| | Electrical Properties | | | | | |
|---|---|---|---|---|---|---|
| | Dark Space Potential | | | Bright Space Potential | | |
| | Before | After | Difference | Before | After | Difference |
| Example 15 | 655 | 660 | −5 | 65 | 70 | 5 |
| Example 16 | 645 | 645 | 0 | 65 | 70 | 5 |
| Example 17 | 645 | 640 | 5 | 60 | 60 | 0 |
| Example 18 | 640 | 635 | 5 | 60 | 60 | 0 |
| Example 19 | 650 | 655 | −5 | 75 | 80 | 5 |
| Example 20 | 645 | 645 | 0 | 75 | 75 | 0 |
| Example 21 | 650 | 650 | 0 | 115 | 145 | 25 |
| Example 22 | 650 | 650 | 0 | 105 | 125 | 20 |
| Example 23 | 645 | 640 | 5 | 65 | 65 | 0 |
| Example 24 | 650 | 650 | 0 | 70 | 70 | 0 |
| Example 25 | 650 | 645 | 5 | 90 | 95 | 5 |
| Example 26 | 655 | 665 | −10 | 90 | 95 | 5 |
| Example 27 | 650 | 655 | −5 | 80 | 80 | 0 |
| Example 28 | 655 | 665 | −10 | 70 | 75 | 5 |
| Example 29 | 650 | 655 | −5 | 75 | 75 | 0 |
| Example 31 | 650 | 650 | 0 | 85 | 125 | 40 |
| Example 32 | 650 | 655 | 5 | 80 | 115 | 35 |
| Example 33 | 660 | 665 | 5 | 75 | 125 | 50 |
| Comparative Example 1 | 655 | — | 15 | 350 | — | 225 |
| Comparative Example 2 | 660 | — | 10 | 275 | — | 175 |
| Comparative Example 3 | 660 | — | 10 | 220 | — | 140 |
| Comparative Example 4 | 655 | — | 25 | 375 | — | 255 |
| Comparative Example 5 | 650 | — | 20 | 300 | — | 210 |
| Comparative Example 6 | 655 | — | 15 | 245 | — | 170 |
| Comparative Example 7 | 660 | 655 | 5 | 210 | 295 | 85 |
| Comparative Example 8 | 650 | 645 | 5 | 155 | 225 | 70 |
| Comparative Example 9 | 640 | 680 | −40 | 65 | 85 | 20 |
| Comparative Example 10 | 660 | 655 | 5 | 225 | 300 | 75 |
| Comparative Example 11 | 655 | 655 | 0 | 170 | 230 | 60 |
| Comparative Example 12 | 640 | 685 | −45 | 55 | 70 | 15 |
| Comparative Example 13 | 640 | 675 | −35 | 75 | 130 | 55 |
| Comparative Example 14 | 645 | 700 | −55 | 70 | 130 | 60 |
| Comparative Example 15 | 640 | 675 | −35 | 65 | 115 | 50 |
| Comparative Example 16 | 640 | 690 | −50 | 60 | 115 | 55 |
| Comparative Example 17 | 650 | 650 | 0 | 90 | 155 | 65 |
| Comparative Example 18 | 645 | 645 | 0 | 80 | 145 | 65 |
| Comparative Example 19 | 645 | 640 | 5 | 75 | 135 | 60 |
| Comparative Example 20 | 650 | 655 | −5 | 70 | 125 | 55 |
| Comparative Example 21 | 650 | 655 | −5 | 85 | 150 | 65 |
| Comparative Example 22 | 650 | 650 | 0 | 80 | 140 | 60 |
| Comparative Example 23 | 645 | 640 | 5 | 80 | 140 | 60 |
| Comparative Example 24 | 650 | 650 | 0 | 75 | 125 | 50 |
| Comparative Example 25 | 645 | 655 | −10 | 85 | 160 | 75 |
| Comparative Example 26 | 655 | 665 | −10 | 80 | 140 | 60 |

TABLE 3-1-continued

| | Electrical Properties | | | | | |
|---|---|---|---|---|---|---|
| | Dark Space Potential | | | Bright Space Potential | | |
| | Before | After | Difference | Before | After | Difference |
| Comparative Example 27 | 650 | 655 | −5 | 95 | 155 | 60 |
| Comparative Example 28 | 650 | 650 | 0 | 95 | 145 | 50 |

TABLE 3-1-continued

| | Electrical Properties | | | | | |
|---|---|---|---|---|---|---|
| | Dark Space Potential | | | Bright Space Potential | | |
| | Before | After | Difference | Before | After | Difference |
| Comparative Example 29 | 645 | 670 | −25 | 85 | 150 | 65 |
| Comparative Example 30 | 655 | 695 | −40 | 90 | 150 | 60 |

TABLE 3-2

| | Image Production | |
|---|---|---|
| | Before | After |
| Example 1 | Good | Good |
| Example 2 | Good | Good |
| Example 3 | Good | Good |
| Example 4 | Good | Good |
| Example 5 | Good | Good |
| Example 6 | Good | Good |
| Example 7 | Good | Good |
| Example 8 | Good | Good |
| Example 9 | Good | Good |
| Example 10 | Good | Good |
| Example 11 | Good | Good |
| Example 12 | Good | Good |
| Example 13 | Good | Good |
| Example 14 | Good | Good |
| Example 15 | Good | Good |
| Example 16 | Good | Good |
| Example 17 | Good | Good |
| Example 18 | Good | Good |
| Example 19 | Good | Good |
| Example 20 | Good | Good |
| Example 21 | Good | Good |
| Example 22 | Good | Good |
| Example 23 | Good | Good |
| Example 24 | Good | Good |
| Example 25 | Good | Good |
| Example 26 | Good | Good |
| Example 27 | Good | Good |
| Example 28 | Good | Good |
| Example 29 | Good | Good |
| Example 31 | Good | Good |
| Example 32 | Good | Good |
| Example 33 | Good | Good |
| Comparative Example 1 | — (*) | — (*) |
| Comparative Example 2 | — (*) | — (*) |
| Comparative Example 3 | — (*) | — (*) |
| Comparative Example 4 | — (*) | — (*) |
| Comparative Example 5 | — (*) | — (*) |
| Comparative Example 6 | — (*) | — (*) |
| Comparative Example 7 | Low image density | Low image density |
| Comparative Example 8 | Low image density | Low image density |
| Comparative Example 9 | Poor dot reproducibility | Very poor dot reproducibility |
| Comparative Example 10 | Low image density | Low image density |
| Comparative Example 11 | Low image density | Low image density |
| Comparative Example 12 | Poor dot reproducibility | Very poor dot reproducibility |
| Comparative Example 13 | Good | Image density deteriorated |
| Comparative Example 14 | Poor dot reproducibility | Very poor dot reproducibility |
| Comparative Example 15 | Good | Image density deteriorated |
| Comparative Example 16 | Poor dot reproducibility | Very poor dot reproducibility |
| Comparative Example 17 | Good | Image density deteriorated |
| Comparative Example 18 | Good | Image density deteriorated |
| Comparative Example 19 | Good | Image density deteriorated |
| Comparative Example 20 | Low image density | Poor dot reproducibility |
| Comparative Example 21 | Good | Image density deteriorated |
| Comparative Example 22 | Good | Image density deteriorated |
| Comparative Example 23 | Good | Image density deteriorated |
| Comparative Example 24 | Low image density | Poor dot reproducibility |
| Comparative Example 25 | Good | Image density deteriorated |
| Comparative Example 26 | Good | Image density deteriorated |
| Comparative Example 27 | Good | Image density deteriorated |
| Comparative Example 28 | Good | Image density deteriorated |

TABLE 3-2-continued

| | Image Production | |
|---|---|---|
| | Before | After |
| Comparative Example 29 | Good | Image density deteriorated |
| Comparative Example 30 | Good | Image density deteriorated |

(*) Running stopped because an abnormal noise was made while running.

Fifty thousand (50,000) lattice images having an image area of 7% were produced by Imagio MP C5000 from Ricoh Company, Ltd. on NBS My Paper (A4 size from Ricoh Company, Ltd.)

—Cleaning Blade Shape & Cleanability Evaluation—

After the images were produced, the cleaning blade edge and contamination of the charging roller were evaluated. The results are shown in Table 4.

TABLE 4

| | Blade | Charging roller contamination |
|---|---|---|
| Example 2 | Slightly chipped | Wholly contaminated with toner |
| Example 6 | Slightly chipped | Wholly contaminated with toner |
| Example 12 | | Wholly contaminated with toner and local stripe contamination |
| Example 31 | No particular change | Only edge is contaminated with toner |
| Example 32 | No particular change | Only edge is contaminated with toner |
| Example 33 | No particular change | Only edge is contaminated with toner |

The electrophotographic photoreceptors in Examples 1 to 29 have very small differences of dark and bright spaces between before and after running. Among these, the electrophotographic photoreceptors using zinc oxide doped with aluminum and gallium have high stability of bright space potentials. Particularly when zinc oxide doped with gallium is used, they have very high stability of bright space potentials, both of dark and bright space potentials hardly vary. Zinc oxide includes much oxygen loss and is oxidized in the atmosphere, resulting in variation of resistivity. However, it is thought this is because zinc oxide doped with a boron group covering the oxygen loss has high stability in the atmosphere. In addition, it is thought as well that this is because gallium is difficult to oxidize in the atmosphere and has high stability.

The electrophotographic photoreceptors in Examples 31 to 33 including a particulate fluorine-containing resin decrease mechanical stress to cleaning blade, and produce stable images for long periods.

The electrophotographic photoreceptors in Comparative Examples 1 to 6 stopped running because of making abnormal noises while running. It is thought this is because the bright space potential increased and a toner was fed less, resulting in abnormal noises in the developing unit.

The electrophotographic photoreceptors in Comparative Examples 7, 8, 10 and 11 do not have much variation of chargeability, but have high bright space potentials from the beginning and they increases much. It is thought this is because the surface resistivity in a high electric field is high, and charge transportability is insufficient and largely deteriorates while the electrophotographic photoreceptors are used.

Particularly, the electrophotographic photoreceptor in Comparative Example 10 having a high surface resistivity greater than $10^{14}$ Ω/cm$^2$ even in a high electric field ($1.5\times10^5$ V/cm) has a very late bright space potential and noticeably deteriorates image density. Differences of the dark and bright space potentials before and after running are so large that the electrophotographic photoreceptor does not have sufficient stability.

The electrophotographic photoreceptors in Comparative Examples 9 and 12 have low dark and bright space potentials from the beginning, but increase after running. It is thought this is because the surface layer includes the inorganic particulate material so much that contact points thereof increase, resulting in a charge trap. The electrophotographic photoreceptors have low surface resistivities in a low electric field, do not have good dot reproducibility from the beginning and worse after running.

The electrophotographic photoreceptors in Comparative Examples 13 and 15 including the charge transportable compound much have good dot reproducibility at the beginning. However, both of the dark and bright space potentials largely vary after running, resulting in deterioration of image density. It is thought this is because the charge transportable compound deteriorates due to running.

The electrophotographic photoreceptors in Comparative Examples 14 and 16 including the charge transportable compound more than those in Comparative Examples 13 and 15 do not have good dot reproducibility from the beginning, and both of the dark and bright space potentials largely vary after running, resulting in almost inability of dot reproduction. It is thought this is because the charge transportable compound deteriorates due to running, resulting in low surface layer resistivity and charge trap formation.

The electrophotographic photoreceptors in Comparative Examples 17 to 19, 21 to 23 and 25 to 30 using zinc oxide not including a boron group and other metal oxides have good surface resistivities, but vary in the dark and bright space potentials before and after running much more than those in Examples. In addition, it is thought that the image density deterioration is due to increase of the bright space potential after running.

The electrophotographic photoreceptors in Comparative Examples 20 and 24 produce images having low image density from the beginning and images having poor dot reproducibility after running. It is thought this is because the surface resistivity stability in a low electric field (R1/R3) is poor from the beginning, and the surface resistivity lowers after running, resulting in deterioration of image resolution.

As a result, the electrophotographic photoreceptor of the present invention maintains very high charge transportability, latent image retainability and producing quality images for long periods.

A modified image forming apparatus Imagio MP C5000 from Ricoh Company, Ltd. was used to perform abrasion durability tests. The image forming apparatus was modified as follows.

A lubricant bar was removed from the process cartridge so as not to provide a lubricant to the electrophotographic photoreceptor from outside. A toner Imagio toner type 27 from Ricoh Company, Ltd. and NBS My Paper (A4 size from Ricoh Company, Ltd.) were used.

The Initial photoreceptor surface potential was −650 V, and 100,000 5% test pattern images were produced. The abrasion depth of the photoreceptor was measured, based on its layer thickness before and after running.

The electrophotographic photoreceptors in Examples 11 to 24 using a resin having a crosslinked structure as a resin having no charge transportability were evaluated, which have low variation between the dark and bright space potentials. The results are shown in Table 5.

An average of five-time measurements under the following conditions was the universal hardness of an electrophotographic photoreceptor.

Apparatus: Fischer Scope H-100 from Fischer Instruments K.K.

Software: WIN-HCU from Fischer Instruments K.K.

Max. test load: 1 mN

Load application time: 30 sec

Load increase: 1 mN/30 sec

Creep at the max. test load: 5 sec

Load reduction: 1 mN/30 sec

Creep after unloaded: 5 sec

Indenter: SMC117

The elastic power was measured by the same method of measuring the universal hardness. The elastic power can be determined by the following formula.

Elastic power (%)=100×(maximum power−plastic power)/maximum power

TABLE 5

| | Surface layer | | Abrasion Evaluation | |
|---|---|---|---|---|
| | Hardness ($N/mm^2$) | Elastic power (%) | Abrasion depth (μm) | Surface status |
| Example 11 | 265.3 | 56.2 | 1.9 | No accretion |
| Example 12 | 274.6 | 58.4 | 1.6 | No accretion |
| Example 13 | 291.3 | 60.2 | 1.3 | No accretion |
| Example 14 | 304.2 | 61.6 | 1.1 | No accretion |
| Example 15 | 263.3 | 57.3 | 1.7 | No accretion |
| Example 16 | 278.9 | 58.9 | 1.4 | No accretion |
| Example 17 | 298.5 | 60.6 | 1.1 | No accretion |
| Example 18 | 311.8 | 62.1 | 0.9 | No accretion |
| Example 19 | 275.1 | 54.3 | 1.5 | Slight accretion |
| Example 20 | 260.9 | 51.1 | 3.1 | An accretion |
| Example 21 | 262.1 | 56.1 | 2.2 | No accretion |
| Example 22 | 276.8 | 59.1 | 2.1 | No accretion |
| Example 23 | 230.2 | 52.7 | 3.1 | Slight accretion |
| Example 24 | 190.5 | 48.3 | 6.2 | An accretion |

The electrophotographic photoreceptors in Examples 11 to 18 and 21 to 22 have high abrasion durability and no accretion. The electrophotographic photoreceptor in Example 19 have slight accretion although having high abrasion durability. The electrophotographic photoreceptor in Example 20 have less abrasion durability than that in Example 19 and more accretion. It is thought that this is because the hardness and the elastic power deteriorate due to deterioration of the crosslink density of the surface layer including a compound having a charge transportable structure. Similarly, the electrophotographic photoreceptors in Examples 23 and 24 deteriorate in abrasion durability and increase in accretion. It is thought that this is because the hardness and the elastic power deteriorate due to deterioration of the crosslink density similarly to Examples 19 and 20. Particularly, the electrophotographic photoreceptor in Example 24 wears the whole surface layer.

As a result, a surface layer including a resin having no charge transportability, a crosslinked structure and a universal hardness not less than 250 $N/mm^2$ has less accretion. Further, a surface layer having an elastic power not less than 50% has good abrasion durability and much better abrasion durability when having an elastic power not less than 55%.

Having now fully described the invention, it will be apparent to one of ordinary skill in the art that many changes and modifications can be made thereto without departing from the spirit and scope of the invention as set forth therein.

What is claimed is:

1. An electrophotographic photoreceptor, comprising:

an electroconductive substrate;

a photosensitive layer overlying the electroconductive substrate; and a surface layer overlying the photosensitive layer, wherein the surface layer comprises:

a resin having no charge transportability; and from 20 to 40% by volume of an inorganic particulate material, wherein the inorganic particulate material is a zinc oxide doped with at least one element from Group 13 of the periodic table, and wherein the electrophotographic photoreceptor has a surface specific resistivity (R1) not less than $10^{13}$ $\Omega/cm^2$ when the surface layer has an electric field intensity of $1\times10^4$ V/cm, and a ratio (R1/R15) of the surface specific resistivity (R1) to a surface specific resistivity (R15) when the surface layer has an electric field intensity of $1.5\times10^5$ V/cm of not less than 1,500, wherein the surface layer has a universal hardness not less than 230.2 $N/mm^2$, and wherein the zinc oxide doped with at least one element from Group 13 of the periodic table is a zinc oxide doped with at least one element selected from the group consisting of gallium and indium.

2. The electrophotographic photoreceptor of claim 1, wherein a ratio (R1/R3) of the surface specific resistivity (R1) to a surface specific resistivity (R3) when the surface layer has an electric field intensity of $3\times10^4$ V/cm of from 0.1 to 10.

3. The electrophotographic photoreceptor of claim 1, wherein the zinc oxide doped with at least one element from Group 13 of the periodic table is a zinc oxide doped with a gallium element.

4. The electrophotographic photoreceptor of claim 1, wherein the resin having no charge transportability has a crosslinked structure.

5. The electrophotographic photoreceptor of claim 1, wherein the resin having no charge transportability is at least one resin selected from the group consisting of a polycarbonate resin, acrylic resin, polyarylate resin, styrene resin phenol resin, urethane resin, and silicone resin.

6. The electrophotographic photoreceptor of claim 1, wherein the surface layer further comprises a charge transportable compound in an amount not greater than 20 parts by weight per 100 parts by weight of the resin having no charge transportability.

7. The electrophotographic photoreceptor of claim 1, wherein the surface layer further comprises a particulate fluorine-containing resin.

8. An image forming apparatus, comprising:

the electrophotographic photoreceptor according to claim 1;

a charger configured to charge the surface of the electrophotographic photoreceptor;

an irradiator configured to irradiate the surface of the electrophotographic photoreceptor to form an electrostatic latent image thereon;

an image developer configured to develop the electrostatic latent image with a toner to form a visual image; and a transferer configured to transfer the visual image onto a recording medium, wherein the zinc oxide doped with at least one element from Group 13 of the periodic table is a zinc oxide doped with at least one element selected from the group consisting of gallium and indium.

9. A process cartridge detachable from image forming apparatus, comprising:

the electrophotographic photoreceptor according to claim 1; and one of a charger configured to charge the surface of the electrophotographic photoreceptor;

an irradiator configured to irradiate the surface of the electrophotographic photoreceptor to form an electrostatic latent image thereon;

an image developer configured to develop the electrostatic latent image with a toner to form a visual image; and a transferer configured to transfer the visual image onto a recording medium, wherein the zinc oxide doped with at least one element from Group 13 of the periodic table is a zinc oxide doped with at least one element selected from the group consisting of gallium and indium.

10. The electrophotographic photoreceptor of claim 1, wherein an amount of the at least one element from Group 13 of the periodic table is from 0.001 to 0.2 mol per 1 mol of zinc oxide.

11. The electrophotographic photoreceptor of claim 1, wherein an amount of the at least one element from Group 13 of the periodic table is from 0.002 to 0.1 mol per 1 mol of zinc oxide.

12. The electrophotographic photoreceptor of claim 1, wherein an amount of the at least one element selected from the group consisting of gallium and indium is from 0.001 to 0.2 mol per 1 mol of zinc oxide.

13. The electrophotographic photoreceptor of claim 1, wherein an amount of the at least one element selected from the group consisting of gallium and indium is from 0.002 to 0.1 mol per 1 mol of zinc oxide.

* * * * *